US007232334B2

(12) United States Patent
Shimizu et al.

(10) Patent No.: US 7,232,334 B2
(45) Date of Patent: Jun. 19, 2007

(54) ELECTRICAL CONNECTING DEVICE

(75) Inventors: Kaneyoshi Shimizu, Osaka (JP); Shozaburo Koyama, Osaka (JP); Masato Naganawa, Osaka (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/471,451

(22) Filed: Jun. 20, 2006

(65) Prior Publication Data

US 2006/0286859 A1 Dec. 21, 2006

(30) Foreign Application Priority Data

Jun. 21, 2005 (JP) ..... 2005-180045

(51) Int. Cl.
*H01R 12/24* (2006.01)

(52) U.S. Cl. ..... 439/496; 439/493

(58) Field of Classification Search ..... 439/492, 439/494, 495, 496, 499, 497
See application file for complete search history.

(56) References Cited

U.S. PATENT DOCUMENTS 6,165,008 A * 12/2000 Wu et al. ..... 439/492
6,558,186 B1 * 5/2003 LePottier et al. ..... 439/496
6,821,158 B2 * 11/2004 Iida et al. ..... 439/660
6,884,108 B2 * 4/2005 Saito et al. ..... 439/495
6,974,344 B2 * 12/2005 Comerci ..... 439/329
2006/0035515 A1 * 2/2006 Pabst ..... 439/492

FOREIGN PATENT DOCUMENTS

JP 2000-021478 1/2000

OTHER PUBLICATIONS

Patent Abstracts of Japan; Publication No. 2000-021478; Date of Publication: Jan. 21, 2000 (1 page).

* cited by examiner

*Primary Examiner*—James R. Harvey
*Assistant Examiner*—Travis Chambers
(74) *Attorney, Agent, or Firm*—Osha Liang LLP

(57) ABSTRACT

A flat cable 11 has a connecting end 23 provided with a conductor exposing part 24, in which an insulating coating 22 is removed so as to be electrically connected to a plurality of terminals 3 and a plurality of conductors 21 are exposed. A cable holder 12 has a cable winding part 26 around which the conductor exposing part 24 is wound so as to be turned back and a provisional holding part 27 which is rotatably supported and presses and holds the connecting end 23. A fitting housing 13, is fitted into a to-be-connected housing element 2 with the connecting end 23 and the cable holder 12 inserted thereto. A clamping part 14 is arranged in an insertion port 36 of the fitting housing 13, presses the provisional holding part 27 to the cable winding part 26, and presses and clamps the connecting end 23 to the cable winding part 26 from both sides.

14 Claims, 21 Drawing Sheets

ELECTRICAL CONNECTING DEVICE

TECHNICAL FIELD

The present invention relates to an electrical connecting device used for electrically connecting a flat cable, which is generally called FFC (Flexible Flat Cable), FPC (Flexible Printed Cable), etc., and has a plurality of conductors, to a plurality of terminals.

BACKGROUND ART

As an electrical connecting device used for electrically connecting a flat cable, which is generally called FFC, FPC, etc., and has a plurality of conductors, to a plurality of terminals, a connector for pressing the flat cable to be inserted into an insulating housing to the plurality of terminals equipped to the insulating housing with a pressing member has been conventionally known (see Japanese Published Unexamined Patent Application No. 2000-21478). The connector disclosed in Japanese Published Unexamined Patent Application No. 2000-21478 includes two types of terminals, a provisional holding terminal and a non-holding terminal of which the plurality are mutually arranged, and holds the flat cable with the two types of terminals and the pressing member.

However, in the conventional electrical connecting devices as disclosed in Japanese Published Unexamined Patent Application No. 2000-21478, the flat cable is clamped and held between the two types of terminals and the pressing member. Thus, the conventional electrical connecting devices are inferior in terms of strongly holding the flat cable and reliably locking it. The flat cable easily comes out in a case where the electrical connecting device is used under an environment that vibration or outer force is easily applied thereto, and therefore it is difficult to keep a holding state of the flat cable.

Additionally, in terms of improving the holding force of the flat cable, for example, it is conceived that the flat cable is held by a holder and the holder is connected to a to-be-connected housing that supports the plurality of terminals. However, it is difficult to realize construction for sufficiently ensuring contact force of the plurality of the conductors of the flat cable and the plurality of terminals in this case.

DISCLOSURE OF THE INVENTION

The present invention has been made in view of the above-described problems, and relates to an electrical connecting device used for electrically connecting a flat cable having a plurality of conductors to a plurality of terminals. It is an object of the present invention to provide the electrical connecting device capable of reliably keeping a holding state of the flat cable by locking it, and capable of ensuring a sufficient contact force of the flat cable and the terminals even if used under an environment that vibration or outer force is easily applied thereto.

The electrical connecting device of the present invention is connected to a to-be-connected housing element that supports the plurality of terminals, and electrically connects the flat cable to the plurality of terminals.

Additionally, the present invention has some features as described below in order to achieve the above-described object. That is, the present invention independently includes the features as described below or includes a suitable combination of any of the features.

In order to achieve the above-described object, a first feature of the electrical connecting device according to the present invention is that the electrical connecting device includes: the flat cable of which an end is a connecting end provided with a conductor exposing part in which an insulating coating is removed so as to be brought into contact with and electrically connected to the plurality of terminals and a plurality of conductors are exposed; a cable holder having a cable winding part around which the conductor exposing part is wound so as to be turned back, and a provisional holding part which is rotatably supported in relation to the cable winding part, and presses and holds the connecting end; a fitting housing in which an insertion port, into which the cable holder is inserted with the connecting end held and the conductor exposing part wound, is formed, and which fits into the to-be-connected housing element with the cable holder inserted into the insertion port; and a clamping part which is formed in the fitting housing so as to be arranged in the insertion port, and which presses the provisional holding part to the cable winding part, and presses and clamps the connecting end turned back to the cable winding part from both sides when the cable holder is inserted into the insertion port.

According to this configuration, the conductor exposing part of the flat cable is wound around the cable winding part of the cable holder, and further the connecting end is pressed and held by the provisional holding part. The flat cable and the cable holder are inserted into the insertion port of the fitting housing in this state, and the clamping part formed in the insertion port presses the provisional holding part to the cable winding part, and presses and clamps the connecting end to the cable winding part from both the sides. Then, the electrical connecting device is connected to the to-be-connected housing element, and the electrical connection of the flat cable and the plurality of terminals is completed. Therefore, according to the electrical connecting device, when the cable holder is inserted into the fitting housing, the flat cable wound around the cable winding part and pressed by the provisional holding part is strongly held by the clamping part. Further, since the conductor exposing part is wound around the cable winding part so as to be turned back, the conductor exposing part of which both the sides are exposed is clamped toward the cable winding part by the plurality of terminals so that each conductor can be brought into contact with each terminal by a high contact force. Therefore, the electrical connecting device can reliably keep the holding state of the flat cable by locking it, and can ensure the sufficient contact force of the flat cable and the terminals even if used under an environment that the vibration or outer force is easily applied thereto.

A second feature of the electrical connecting device according to the present invention is that the flat cable is an extrusion type flat cable in which the plurality of conductors and the insulating coating are integrally formed by extrusion molding.

According to this configuration, since the extrusion type flat cable is employed, layer-shaped peeling can hardly arise compared with a laminate type flat cable formed in a layer-shape.

A third feature of the electrical connecting device according to the present invention is that the connecting end of the flat cable includes the conductor exposing part formed by pulling and peeling the insulating coating along a extending direction of the plurality of conductors, and an insulating coating part arranged so that a part of the pulled insulating coating is left in the connecting end.

According to this configuration, the insulating coating at the end side of the flat cable is pulled and peeled in the extending direction of the conductors so that the connecting end can be easily formed which has a configuration that the insulating coating part is arranged at a top end of the flat cable and the conductor exposing part is adjacently arranged to the insulating coating part. Thus, the insulating coating part can be used as a part for being hooked on the cable holder in order to improve the holding force of the flat cable. That is, it is unnecessary to perform a troublesome process such as opening a hole to provide a part to be hooked on the cable holder in the flat cable, therefore, man-hours can be suppressed.

A fourth feature of the electrical connecting device according to the present invention is that thick parts are provided at a top end of the provisional holding part of the cable holder opposite the side thereof rotatably supported in relation to the cable winding part so as to bend the insulating coating part when the connecting end is pressed.

According to this configuration, the insulating coating part is bent by a simple configuration, in which the thick parts are provided at the top end of the provisional holding part, when the provisional holding part presses the connecting end, and therefore the holding force of the flat cable can be improved.

A fifth feature of the electrical connecting device according to the present invention is that a step part capable of being locked to the insulating coating part with the connecting end pressed by the provisional holding part is provided aside of the cable winding part of the cable holder.

According to this configuration, since the provisional holding part presses the connecting end and the insulating coating part is locked to the step part provided aside of the cable winding part, the holding force of the flat cable can be easily improved.

A sixth feature of the electrical connecting device according to the present invention is that the cable winding part of the cable holder includes an upper surface and a lower surface formed so as to be arranged in parallel with each other.

According to this configuration, the conductor exposing part is wound so as to be turned back along the upper surface and the lower surface arranged in parallel with each other. Thus, both surfaces of the conductor exposing part, which are exposed in parallel with each other along the upper surface and the lower surface, can be pressed to the cable winding part so as to be clamped in a direction of facing each other by the plurality of the terminals. And thus, each conductor can be reliably brought into contact with each terminal by the high contact force.

A seventh feature of the electrical connecting device according to the present invention is that a plurality of ribs are formed in the cable winding part of the cable holder, so as to be respectively located between the plurality of conductors that are exposed at the conductor exposing part and arranged in parallel with each other at the time of winding the conductor exposing part.

According to this configuration, each rib is arranged between conductors extended in parallel with each other in the conductor exposing part in the state where the conductor exposing part of the flat cable is wound around the cable winding part of the cable holder. Thus, an insulating state between the conductors is always ensured by the rib. Therefore, even if the interval between the conductors and the interval between the terminals are narrow, a short between the conductors caused by a remain or burr easily generated by friction between the conductor and the terminal or a whisker educed by plating inside stress, etc., can be suppressed.

An eighth feature of the electrical connecting device according to the present invention is that: side walls are formed which are erected at both sides of a width direction of the cable winding part of the cable holder respectively; a first projecting part is formed on either the provisional holding part or the side wall of the cable holder and a first recessed part is formed on the other; and the first projecting part is engaged with the first recessed part in the state where the provisional holding part presses the connecting end.

According to this configuration, the connecting end wound around the cable winding part and pressed by the provisional holding part is further strongly held by the engagement of the first projecting parts and the first recessed parts, and the flat cable can be more reliably locked.

A ninth feature of the electrical connecting device according to the present invention is that: a flexible first elastic deforming part, on which a projection for locking to the to-be-connected housing element when the fitting housing is inserted into the to-be-connected housing element is formed, is provided in the fitting housing; and the fitting housing is inserted into the to-be-connected housing element after locking of the projection and the to-be-connected housing element so that the first elastic deforming part is deformed, hence the locking of the projection and the to-be-connected housing element is released and the fitting of the fitting housing and the to-be-connected housing element is completed.

According to this configuration, when the fitting housing is inserted into the to-be-connected housing element, the projection of the fitting housing is first locked to the to-be-connected housing element. Then, the fitting housing is further inserted into the to-be-connected housing element from this state, and thus the locking of the projection and the to-be-connected housing element is released and inertial force (force by which the fitting housing is energized so as to be abruptly accelerated by the release of the locking and moves in the insertion direction) is generated. The fitting of the fitting housing and the to-be-connected housing element can be completed with use of the inertial force. Thus, it is possible to prevent a half-fitting state, a state of unfinished fitting, from being generated.

A tenth feature of the electrical connecting device according to the present invention is that the fitting housing includes a detour forming part which runs along an inner wall formed in the to-be-connected housing element so as to form the detour which covers a contact region, in which the conductor exposing part comes into contact with the plurality of terminals, and leads to the contact region when the fitting housing is fitted into the to-be-connected housing element.

According to this configuration, the contact region of the conductor exposing part and the terminals is covered with the detour forming part of the fitting housing in the state where the fitting housing is fitted into the to-be-connected housing element. Further, the detour is formed between the contact region and the outside by the inner wall in the to-be-connected housing element and the detour forming part of the fitting housing. Thus, intrusion of liquid such as water from the outside to the contact region can be effectively suppressed.

An eleventh feature of the electrical connecting device according to the present invention is that: the inner wall in the to-be-connected housing element is a to-be-connected housing side wall erected and formed so as to surround the circumference of the plurality of terminals; and the detour forming part is a fitting housing side wall erected and formed so as to surround the circumference of the to-be-connected housing side wall when the fitting housing is fitted into the to-be-connected housing element.

According to this configuration, since the fitting housing side wall as the detour forming part is formed on the circumference of the to-be-connected housing side wall as the inner wall provided on the circumference of the plurality of terminals in the to-be-connected housing element, the detour can be formed with a simple mechanism.

A twelfth feature of the electrical connecting device according to the present invention is that the clamping part includes an upper side clamping part for pressing the provisional holding part to the cable winding part and a lower side clamping part formed so as to be extended along the cable winding part in a side where the flat cable is wound around the cable winding part and pulled, and presses and clamps the connecting end turned back between the upper side clamping part and the lower side clamping part to the cable winding part from both the sides.

According to this configuration, since the upper side clamping part and the lower side clamping part arranged so as to clamp the provisional holding part and the cable winding part from both the sides are provided, the clamping part for clamping the connecting end turned back by pressing the cable winding part from both the sides can be formed with the simple mechanism.

A thirteenth feature of the electrical connecting device according to the present invention is that the upper side clamping part and the provisional holding part respectively include a taper, the tapers being formed as taper-shaped surfaces which are brought into contact with each other to be energized by inserting the cable holder into the insertion port.

According to this configuration, since the upper side clamping part and the provisional holding part include the tapers which energize each other, respectively, the cable holder is press-inserted into the insertion port of the fitting housing so as to be strongly clamped by the clamping part.

A fourteenth feature of the electrical connecting device according to the present invention is that the upper side clamping part is provided as a flexible second elastic deforming part formed so as to be extended in a cantilever-shape toward an opening side of the insertion port.

According to this configuration, since the upper side clamping part is formed as the flexible second elastic deforming part so as to be extended in the cantilever-shape, the provisional holding part can be strongly pressed with use of elastic force of the upper side clamping part. Thus, a high clamping force of the clamping part can be ensured by a simple configuration that the second elastic deforming part is formed.

A fifteenth feature of the electrical connecting device according to the present invention is that the lower side clamping part is provided as a flexible third elastic deforming part formed so as to be extended in the cantilever-shape toward the opening side of the insertion port.

According to this configuration, since the lower side clamping part is formed as the flexible third elastic deforming part soas tobe extended in the cantilever-shape, the cable winding part can be strongly pressed with use of elastic force of the lower side clamping part. Thus, the high clamping force of the clamping part can be ensured by a simple configuration that the third elastic deforming part is formed.

A sixteenth feature of the electrical connecting device according to the present invention is that: a second projecting part is formed on either the side of the cable holder or the insertion port of the fitting housing and a second recessed part is formed on the other; and the second projecting part is engaged with the second recessed part in a position where insertion of the cable holder into the insertion port is completed.

According to this configuration, the cable holder is further strongly held by the fitting housing due to the engagement of the second projecting parts and the second recessed parts, and therefore the flat cable can be more reliably locked.

Moreover, the above-described and the other objects, features and advantages of the present invention will become apparent by reading the following description with reference to the attached drawings.

BEST MODE FOR CARRYING OUT THE INVENTION

The best mode for carrying out the present invention will be described hereinafter with reference to the accompanying drawings. The present invention is used for electrically connecting a flat cable, which is generally called FFC (Flexible Flat Cable), FPC (Flexible Printed Cable), etc., and has a plurality of conductors, to a plurality of terminals. The present invention is widely applicable to an electrical connecting device that is connected to a to-be-connected housing element supporting a plurality of terminals and electrically connects the flat cable to the plurality of terminals. For example, the present invention can be employed as various connectors used for automobiles, however, it is not limited to that application, and can be applied to wider applications, many different environments and various purposes.

Figure 1:
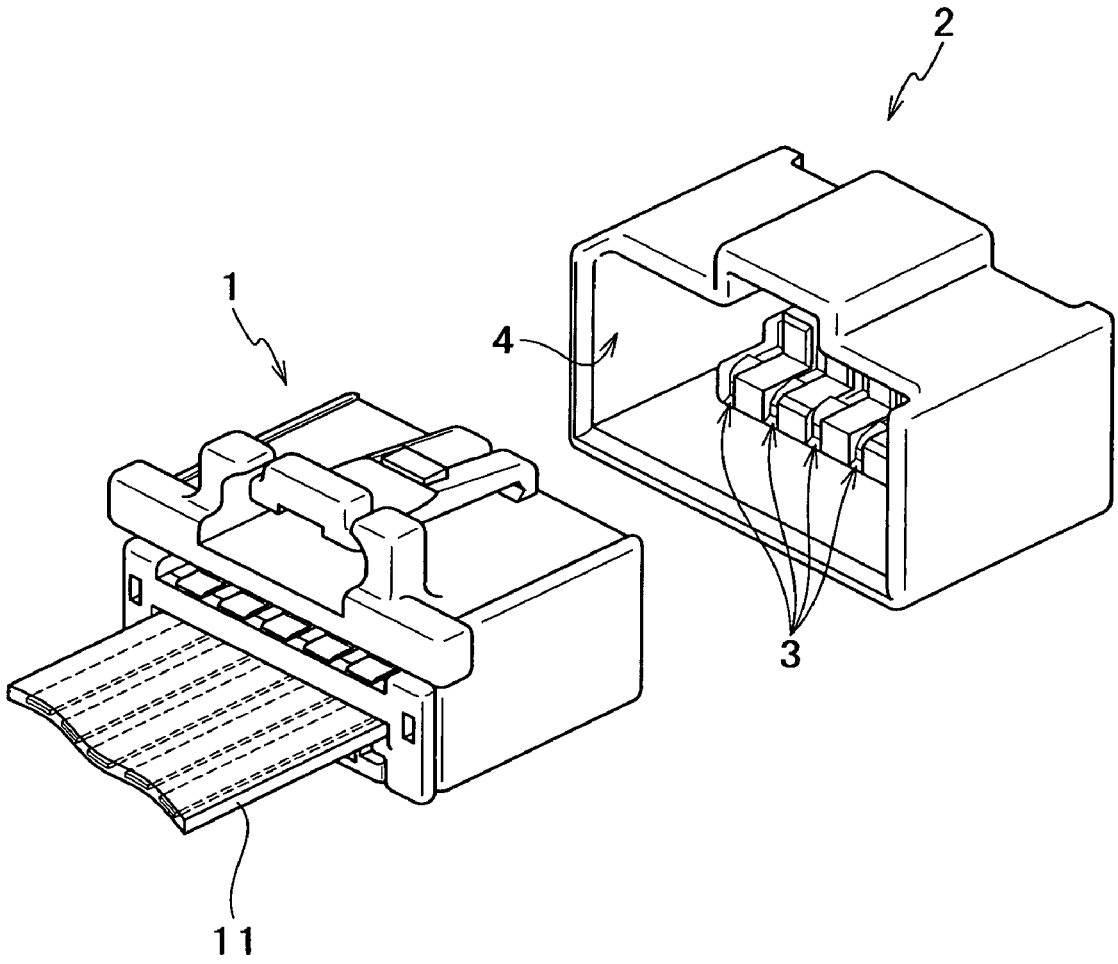
FIG. 1 is a perspective view showing an electrical connecting device according to an embodiment of the present invention and a to-be-connected housing element to be connected to the electrical connecting device.

FIG. 1 is a perspective view showing an electrical connecting device 1 according to the embodiment of the present invention and a to-be-connected housing element 2 to be connected to the electrical connecting device 1. The to-be-connected housing element 2 is formed so that the external form thereof becomes substantially rectangular, and supports a plurality of terminals 3. The plurality of terminals 3 are supported in an exposed state in an opening 4 formed at a side of the to-be-connected housing element 2. That is, the plurality of terminals 3 supported by a supporting part (see FIG. 19, etc.) formed at the other side of the to-be-connected housing element 2 are arranged being projected and exposed in the opening 4.

Figure 2:
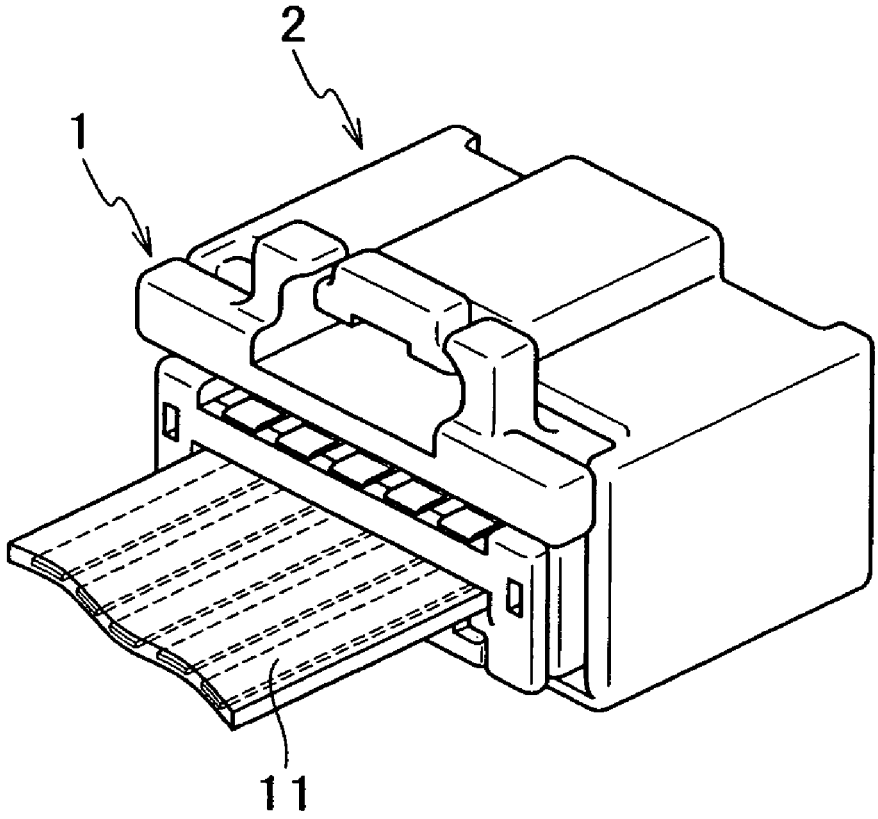
FIG. 2 is a perspective view showing a state where the electrical connecting device is connected to the to-be-connected housing element, the device and element being shown in FIG. 1.

The electrical connecting device 1 of the present embodiment, in which a flat cable 11 is held, is inserted into the opening 4 of the to-be-connected housing element 2 and fitted into the element 2 as shown in FIG. 1. FIG. 2 is a perspective view showing a state where the electrical connecting device 1 is fitted into the to-be-connected housing element 2. The electrical connecting device 1 is electrically and mechanically connected to the to-be-connected housing element 2 by completion of the fitting state as shown in FIG. 2, and the flat cable 11 is electrically connected to the plurality of terminals 3.

Figure 3:
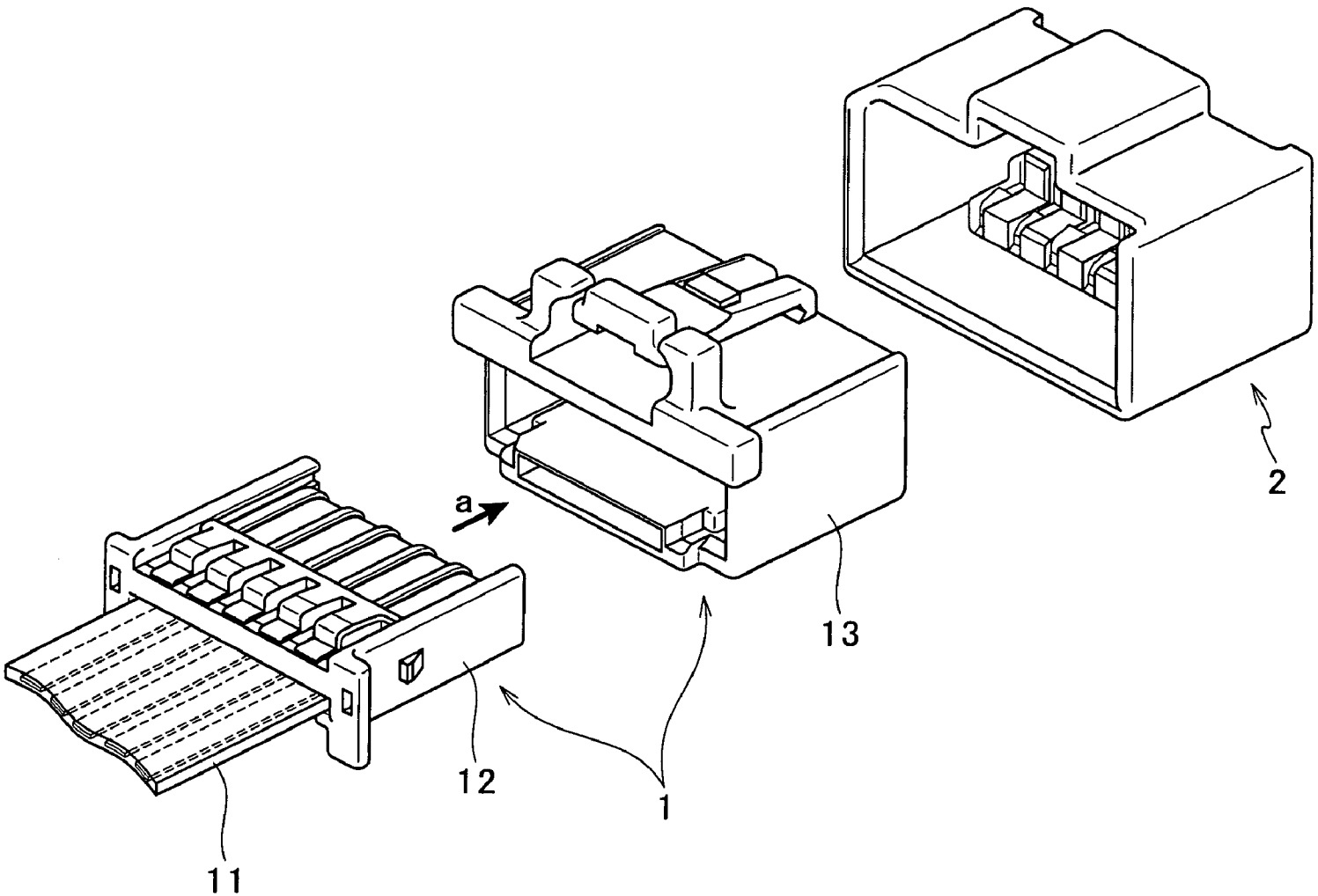
FIG. 3 is an exploded perspective view of the electrical connecting device and the to-be-connected housing element shown in FIG. 1.

FIG. 3 is an exploded perspective view of the electrical connecting device 1 and the to-be-connected housing element 2. As shown in FIG. 3, the electrical connecting device 1 includes the flat cable 11, a cable holder 12 and a fitting housing 13. Additionally, the electrical connecting device 1 includes a clamping part 14 (see FIG. 16, etc.) formed in the fitting housing 13 as described below. Moreover, the cable holder 12 which provisionally holds the flat cable 11 is inserted in the arrow a direction in FIG. 3, and a state of the electrical connecting device 1 shown in FIG. 1 is completed.

Figure 4A:
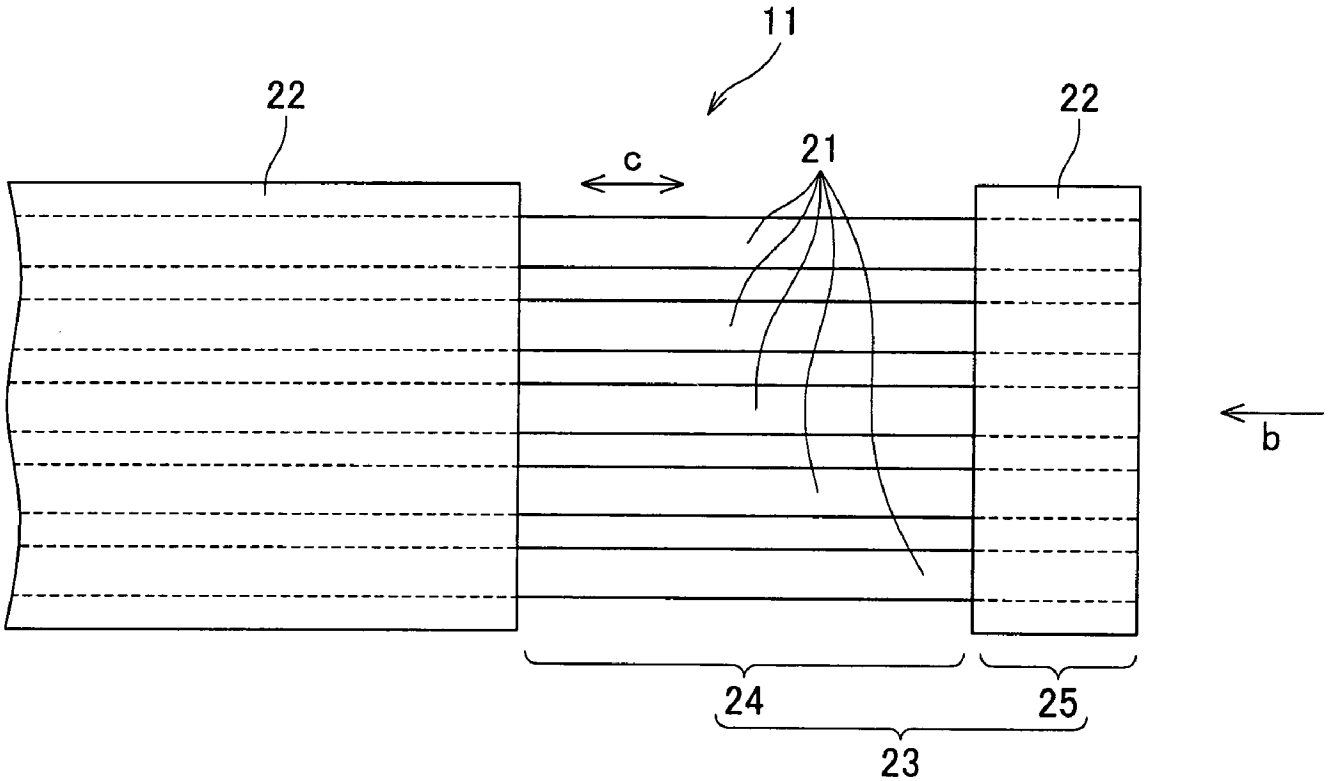
FIG. 4 is a partial view of a flat cable shown in FIG. 3, FIG. 4(*a*) is a plan view of the flat cable and FIG. 4(*b*) is a side view of the flat cable.
Figure 4B:
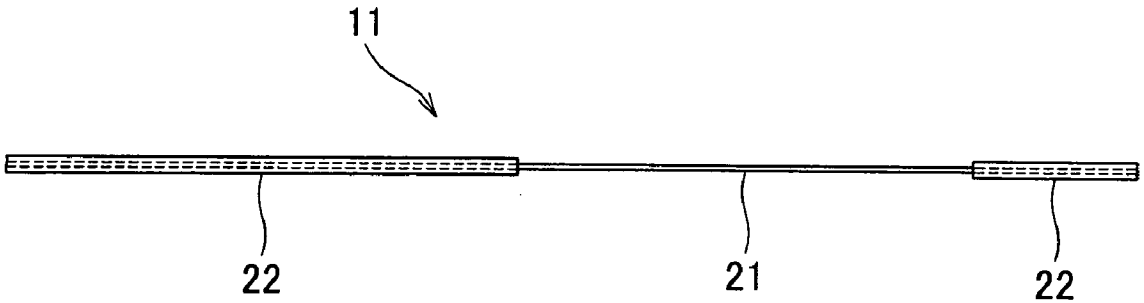
Figure 5:
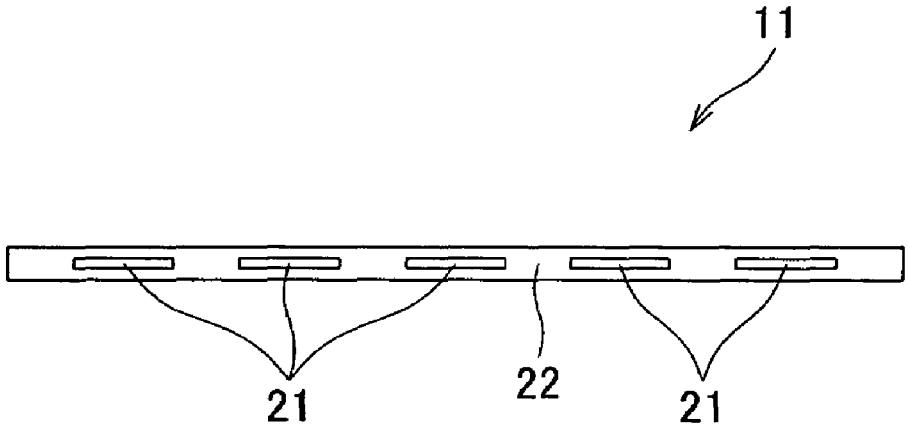
FIG. 5 is a front view of an end of the flat cable observed from an arrow b in FIG. 4(*a*).

FIG. 4 is a partial view of the flat cable 11, and FIG. 4(*a*) is a plan view of the flat cable 11 and FIG. 4(*b*) is a side view of the flat cable 11. Additionally, FIG. 5 is a front view of an end of the flat cable 11 observed from the arrow b in FIG. 4(*a*). As shown in FIG. 4 and FIG. 5, the flat cable 11 is configured as a flexible flat cable which includes a plurality of conductors 21 arranged so as to be extended in parallel with each other and an insulating coating 22 for coating the plurality of conductors 21. Moreover, in FIG. 4, a case where the five conductors 21 are used as the plurality of conductors 21 is shown as an example. Additionally, the flat cable 11 is configured as an extrusion type flat cable in which the plurality of conductors 21 and the insulating coating 22 are integrally formed by extrusion molding.

Additionally, as shown in FIG. 4, a connecting end 23 provided with a conductor exposing part 24 and an insulating coating part 25 is provided at an end of the flat cable 11. The conductor exposing part 24 is formed as a part, in which the insulating coating 22 is removed and the plurality of conductors 21 are exposed, so as to be brought into contact with and electrically connected to the plurality of terminals 3 supported in the to-be-connected housing element 2. The insulating coating 22 is pulled and peeled along an extending direction (the arrow c direction in FIG. 4) of the plurality of the conductors 21 so that the conductor exposing part 24 is formed. Additionally, the insulating coating part 25 is formed as a part that a part of the insulating coating 22, which is pulled and deviated so that the conductor exposing part 24 is formed, is arranged so as to be left in the connecting end 23.

Figure 6A:
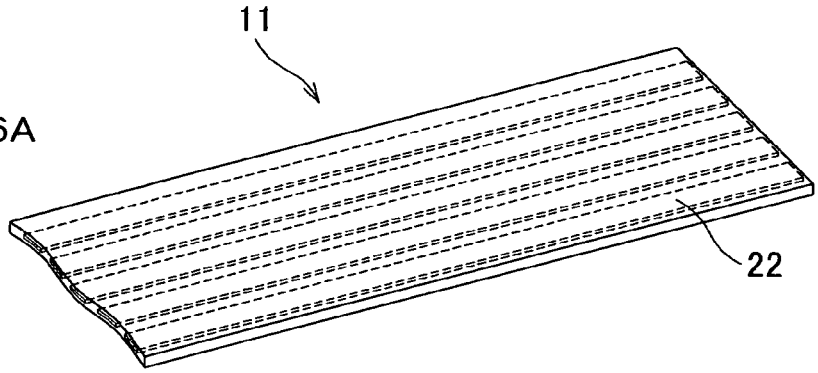
FIG. 6 is a perspective view of the flat cable for description of a process for forming a connecting end of the flat cable shown in FIG. 4.
Figure 6B:
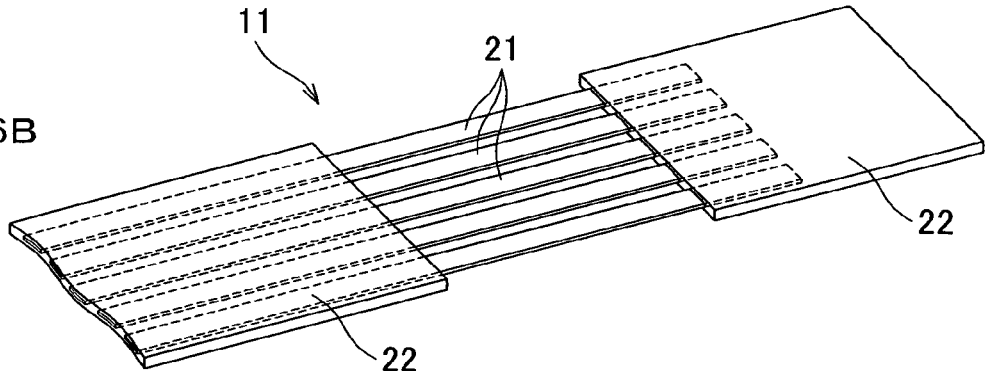
Figure 6C:
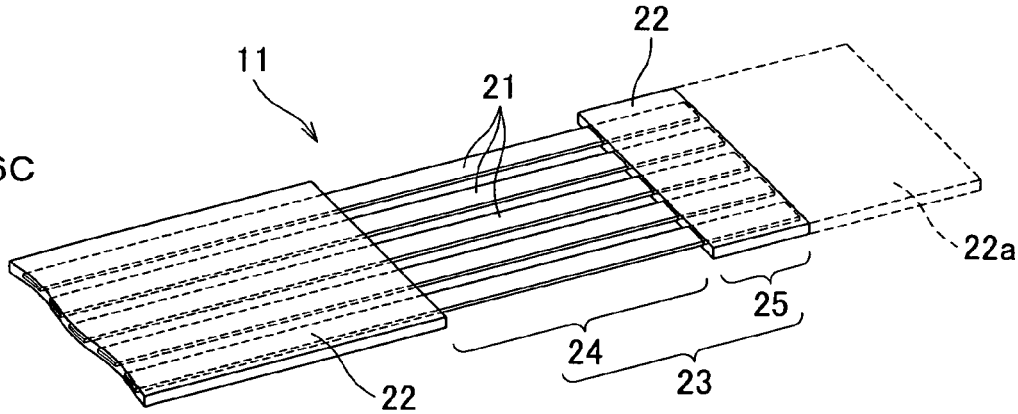

FIG. 6 is a perspective view of the flat cable 11 for description of a process for forming the connecting end 23 having the conductor exposing part 24 and the insulating coating part 25 in the flat cable 11. First, as shown in FIG. 6(*a*), a cut is made into the insulating coating 22 other than the plurality of conductors 21 at a part that the connecting end 23 is to be formed in the flat cable 11, in which the connecting end 23 is not formed yet. Thereafter, as shown in FIG. 6(*b*), the part, into which the cut is made, is pulled along the extending direction of the conductors 21 so that the insulating coating 22 is peeled. Then, as shown in FIG. 6(*c*), an insulating coating end 22*a* (shown as a dotted line in FIG. 6(*c*)), which is a top end side of the pulled insulating coating 22 and in which no conductor 21 is arranged, is cut off and removed in a state where the pulled insulating coating 22 is shifted to a predetermined part. Thus, the connecting end 23 is formed and the flat cable 11 shown in FIG. 4 is then formed.

Figure 7:
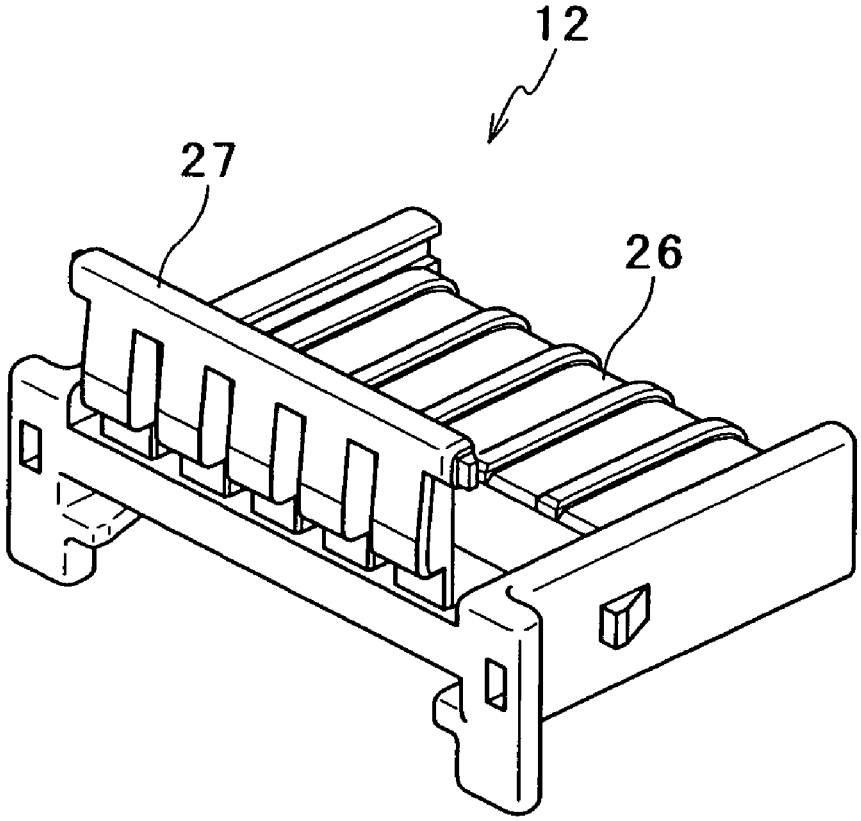
FIG. 7 is a perspective view of the cable holder shown in FIG. 3.

FIG. 7 is a perspective view of the cable holder 12. As shown in FIG. 7, the cableholder 12 includes a cable winding part 26 and a provisional holding part 27. The cable winding part 26 configures a part around which the conductor exposing part 24 of the flat cable 11 is wound so as to be turned back. Additionally, the provisional holding part 27 is rotatably supported in relation to the cable winding part 26. The provisional holding part 27 is rotated with the connecting end 23 of the flat cable 11 arranged between the cable winding part 26 and the provisional holding part 27 to press and hold the connecting end 23.

Here, the configuration and the operation form of the cable holder 12 will be further described. FIG. 8 to FIG. 14 are figures which describe the operation form in holding the flat cable 11 with the cable holder 12. As shown in the perspective view of FIG. 8, a step part 28 formed so as to be recessed in a step-shape at an upper surface side, the side where the provisional supporting part 27 is rotatably attached, is provided at the cable winding part 26 of the cable holder 12. As shown by the dotted line arrow in FIG. 8, the insulating coating part 25 of the connecting end 23 of the flat cable 11 is arranged in the step part 28. FIG. 9 is a perspective view showing a state where the insulating coating part 25 of the flat cable 11 is arranged in the step part 28 of the cable winding part 26 of the cable holder 12.

The provisional holding part 27 is rotated in a direction shown by the dotted line arrow in FIG. 9 with the insulating coating part 25 of the flat cable 11 arranged in the step part 28 of the cable holder 12. Then, as shown in the perspective view of FIG. 10, the connecting end 23 of the flat cable 11 is pressed by the provisional holding part 27 of the cable holder 12.

Figure 8:
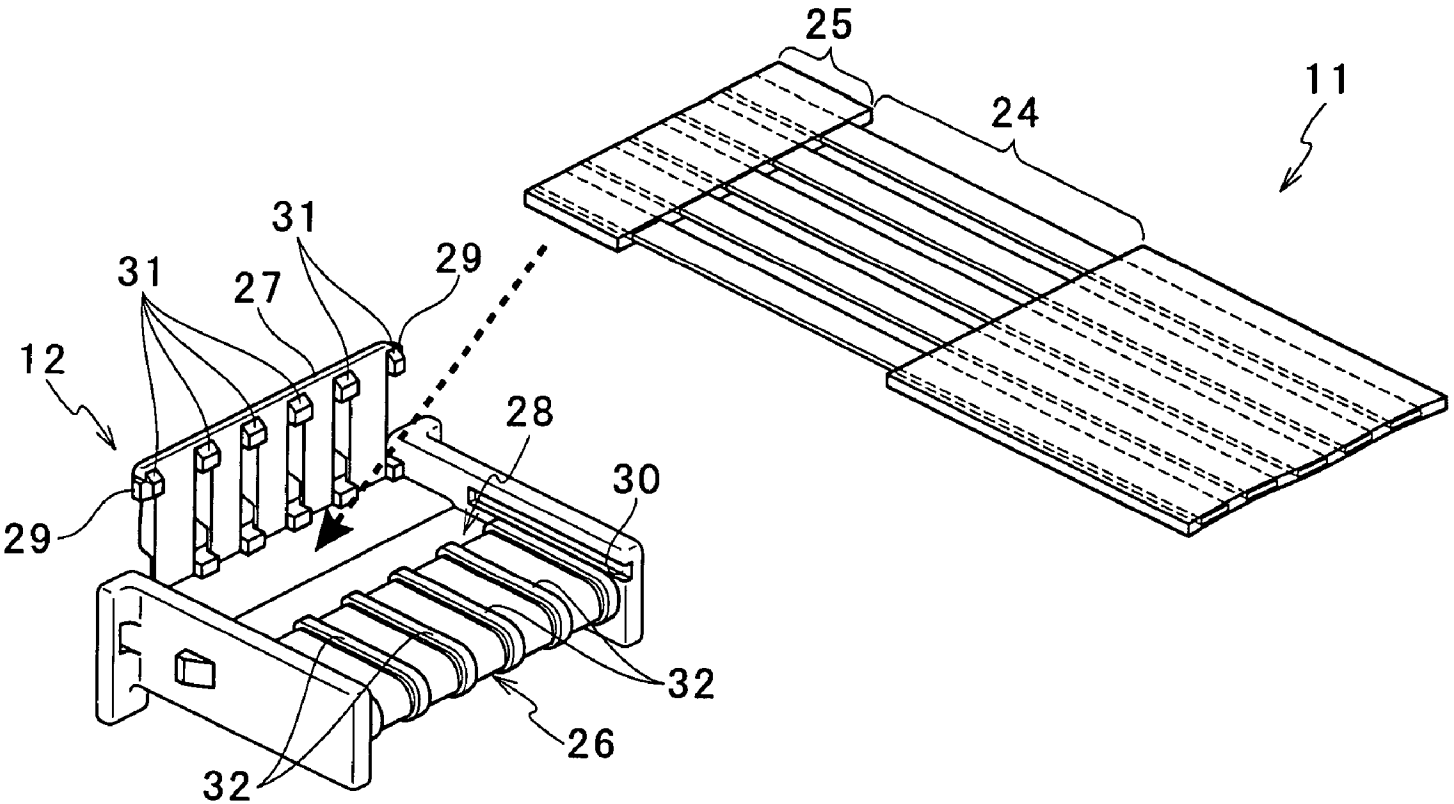
FIG. 8 is a perspective view for description of an operation form in holding the flat cable with the cable holder.
Figure 9:
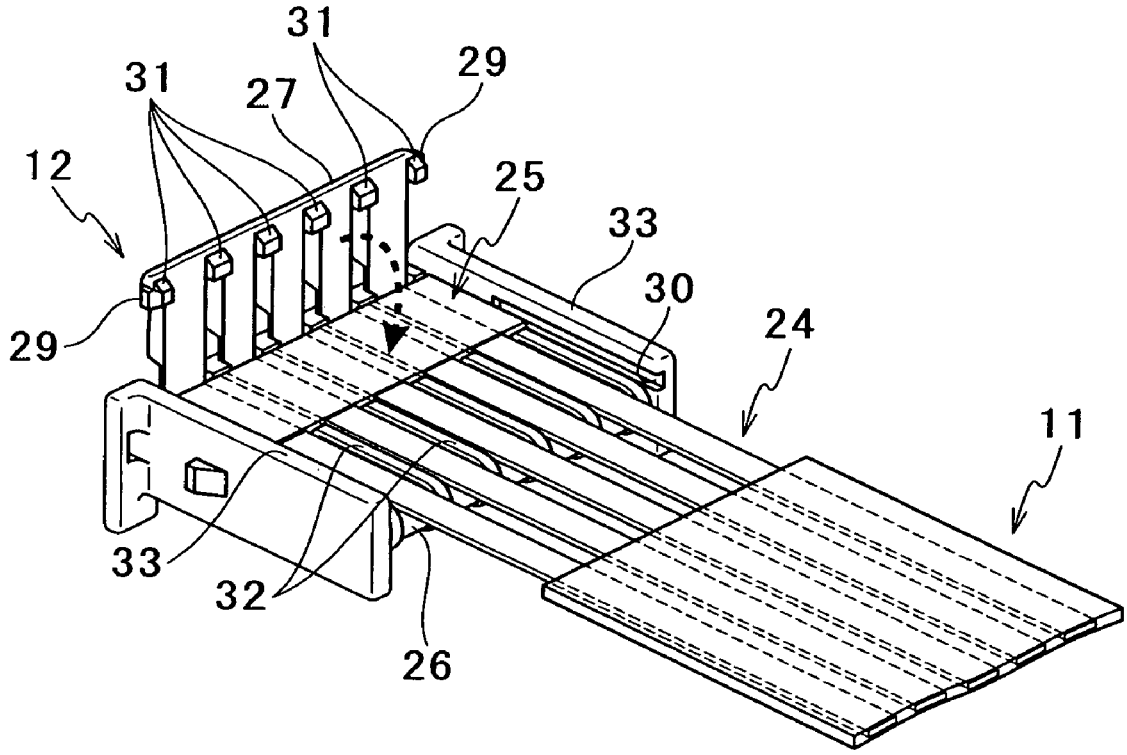
FIG. 9 is a perspective view for description of the operation form in holding the flat cable with the cable holder.
Figure 10:
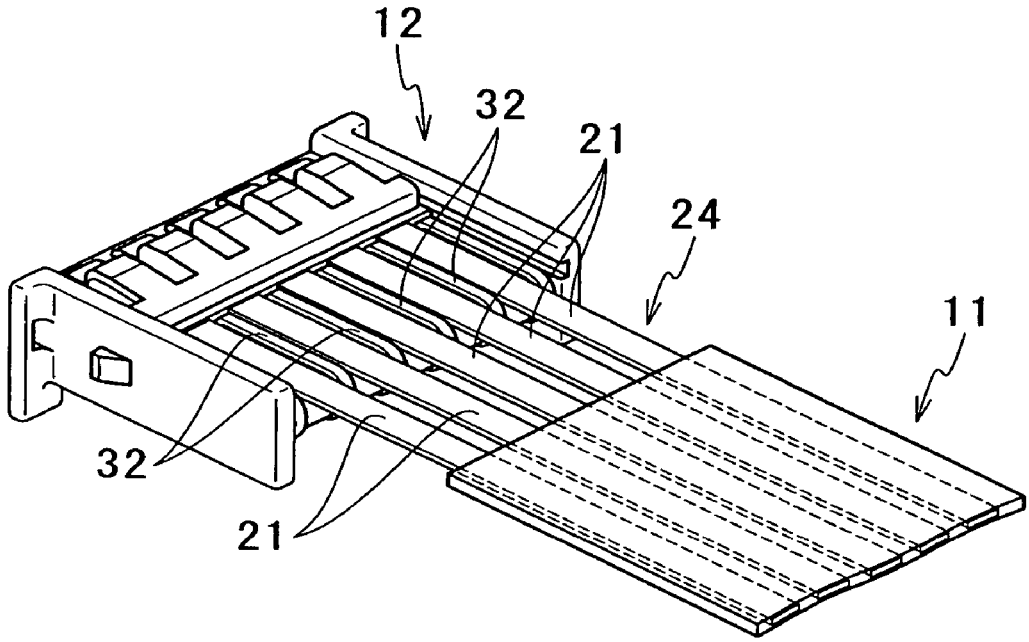
FIG. 10 is a perspective view for description of the operation form in holding the flat cable with the cable holder.

Additionally, as shown in FIG. 8 and FIG. 9, the cable holder 12 includes first projecting parts 29, first recessed parts 30, thick parts 31, ribs 32, side walls 33, etc. The side walls 33 are respectively formed as walls erected at both sides of a width direction of the cable winding part 26. The first projecting parts 29 are respectively provided as a projection at both sides of a width direction of the provisional holding part 27. The first recessed parts 30 are respectively formed as a groove-shaped part formed in a recessed-shape on the inside (the side opposite the cable winding part 26) of the side wall 33. As shown in FIG. 10, in a state where the provisional holding part 27 is rotated to press the connecting end 23 of the flat cable 11, a pair of the first projecting parts 29 are respectively engaged with a pair of the first recessed parts 30. Moreover, recessed parts may be provided on the provisional holding part 27 and projecting parts may be provided on the side wall 33 side.

The plurality of ribs 32 of the cable holder 12 are formed along a cable winding direction of the cable winding part 26. The ribs 32 are exposed at the conductor exposing part 24 and respectively arranged so as to be located between the plurality of conductors 21 arranged in parallel with each other when the conductor exposing part 24 of the flat cable 11 is wound around the cable winding part 26 (see FIG. 10, FIG. 14, etc.).

Figure 11A:
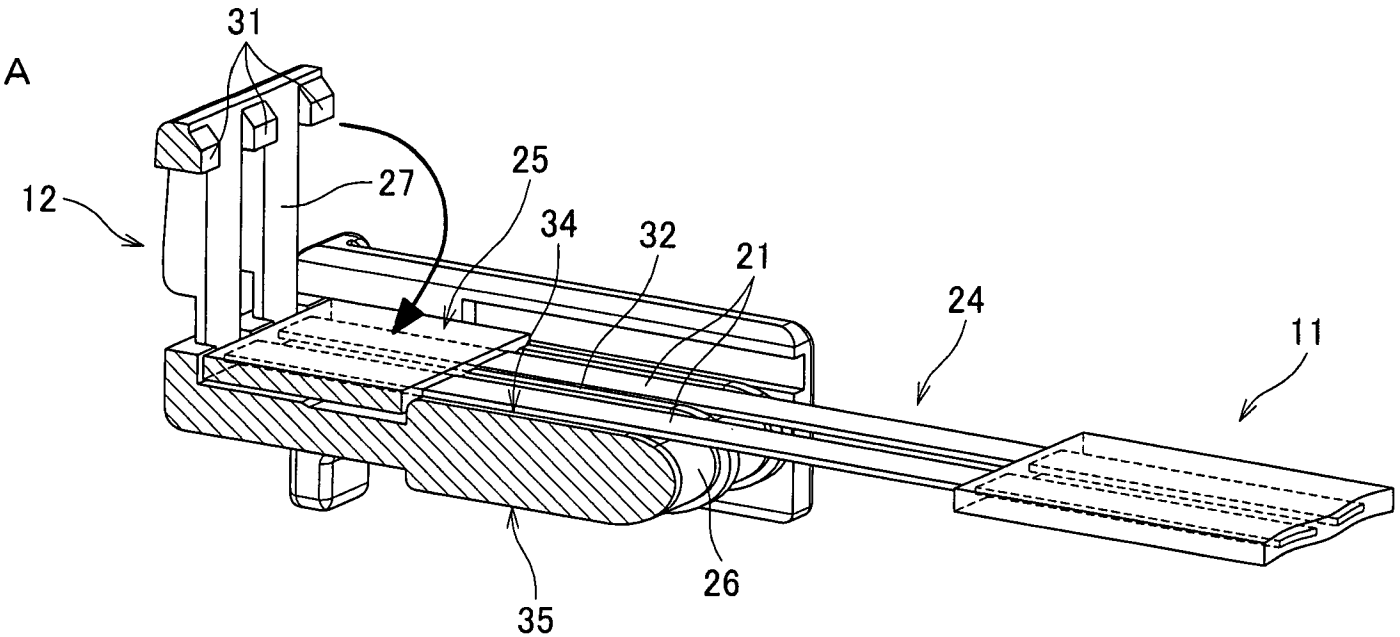
FIG. 11 is across sectional view for description of the operation form in holding the flat cable with the cable holder.
Figure 11B:
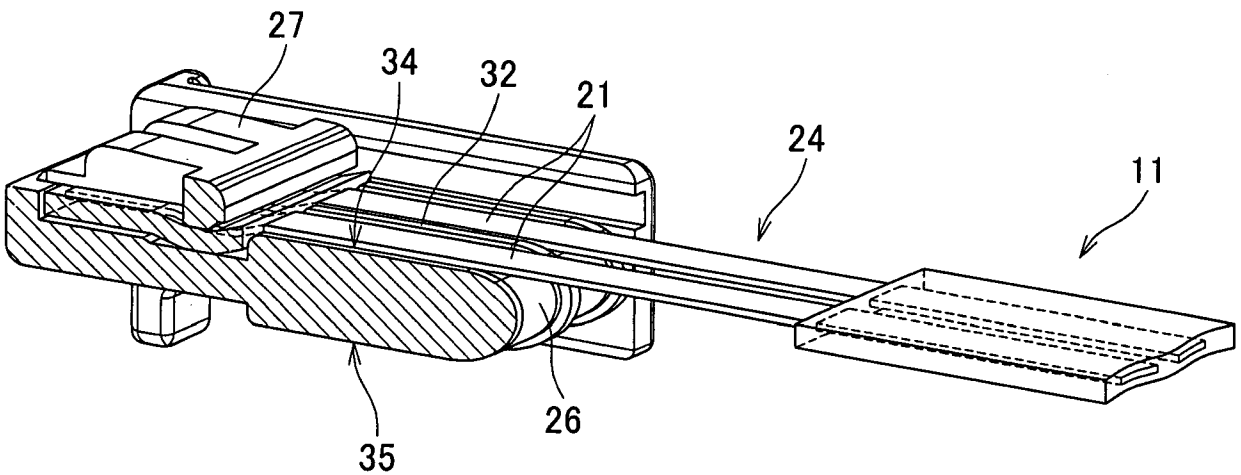
Figure 12:
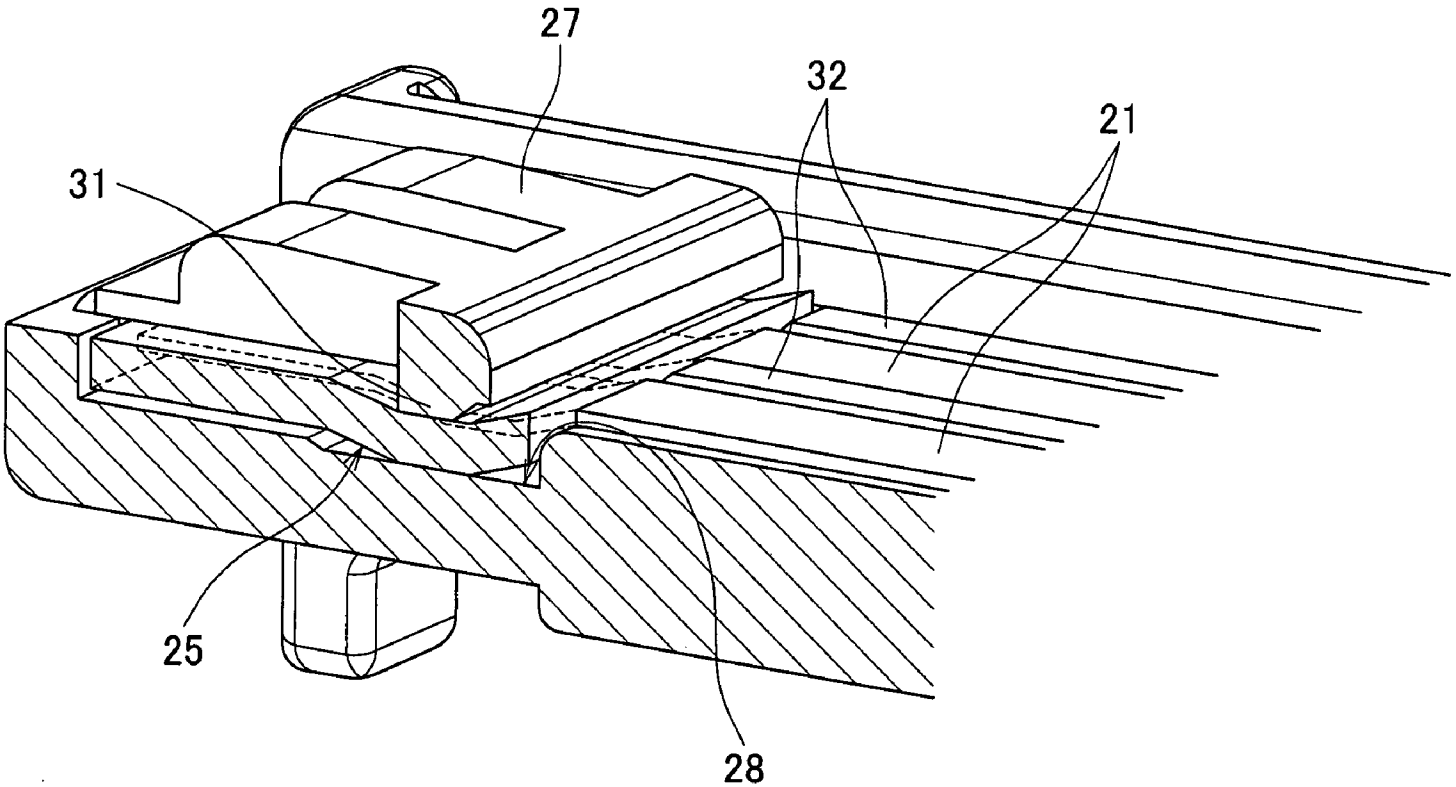
FIG. 12 is a partial enlarged cross sectional view for description of the operation form in holding the flat cable with the cable holder.

As shown in FIG. 9, the thick parts 31 of the cable holder 12 are provided at a top end of the provisional holding part 27 opposite the side thereof rotatably supported in relation to the cable winding part 26. The thick parts 31 are formed so as to bend the insulating coating part 25 when the provisional holding part 27 presses the connecting end 23 of the flat cable 11. FIG. 11(*a*) is a cross sectional view showing a state before the provisional holding part 27 is rotated, and FIG. 11(*b*) is a cros ssectional view showing a state where the provisional holding part 27 is rotated to press the connecting end 23 of the flat cable 11 to the cable winding part 26. Additionally, FIG. 12 is an enlarged cross sectional view of the vicinity of the provisional holding part 27 of FIG. 11(*b*). When the connecting end 23 of the flat cable 11 is pressed by the provisional holding part 27, which is rotated in the arrow direction shown in FIG. 11(*a*), as shown in FIG. 11(*b*) and FIG. 12, the insulating coating part 25 of the connecting end 23 is bent by the thick parts 31 of the provisional holding part 27.

Moreover, as clearly shown in FIG. 12, the step part 28 provided aside of the cable winding part 26 is formed so as to be locked to the insulating coating part 25 with the connecting end 23 pressed by the provisional holding part 27. Additionally, as clearly shown in FIG. 11, the cable winding part 26 includes an upper surface 34 and a lower surface 35 formed so as to be arranged in parallel with each other.

Figure 13:
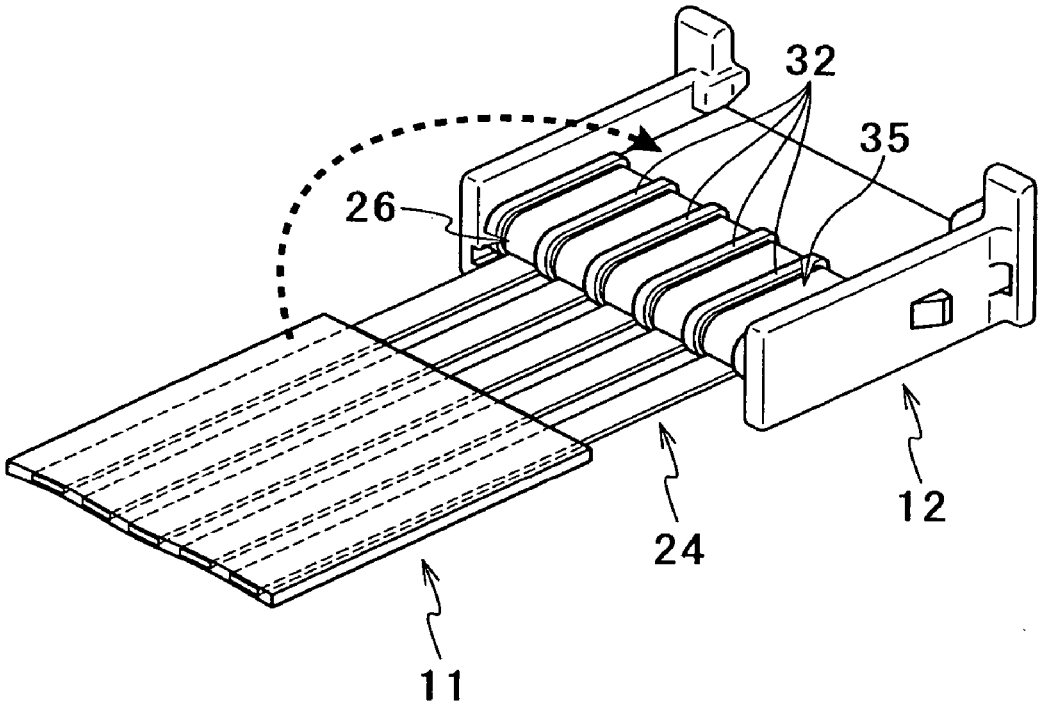
FIG. 13 is a perspective view for description of the operation form in holding the flat cable with the cable holder.
Figure 14:
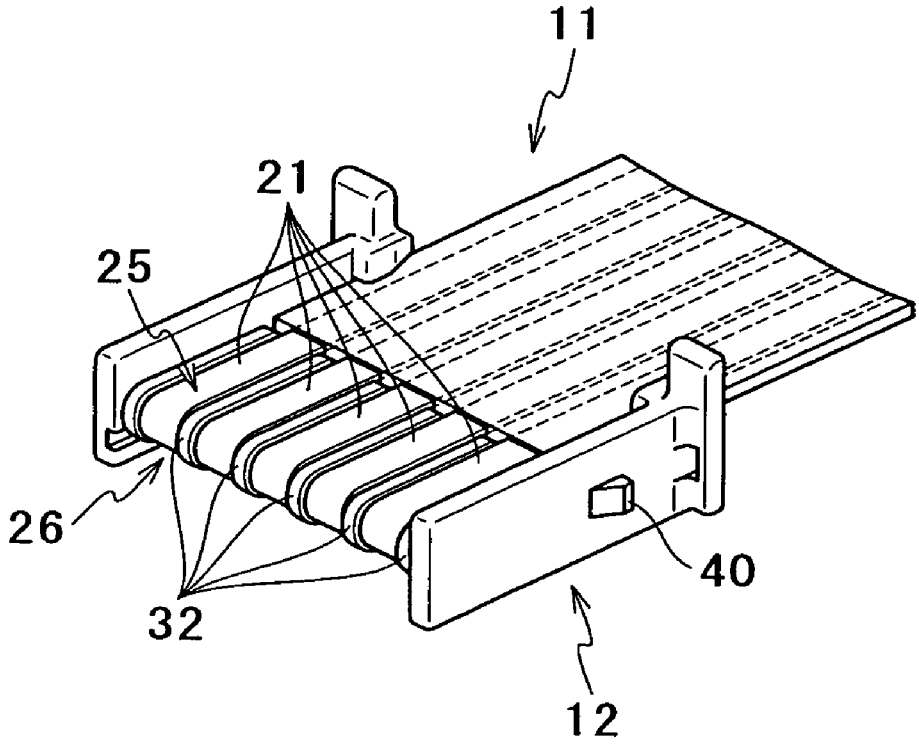
FIG. 14 is a perspective view for description of the operation form in holding the flat cable with the cable holder.

FIG. 13 is a perspective view that the cable holder 12 and the flat cable 11 shown in FIG. 10 are observed from the opposite side (the lower surface 35 side). The conductor exposing part 24 is wound at the upper surface 35 side of the cable winding part 26 as shown in FIG. 10, and then the flat cable 11 is wound in a direction shown by the dotted line arrow in FIG. 13. FIG. 14 is a perspective view showing a state where the flat cable 11 is wound to the lower surface 35 side of the cable winding part 26. In the state shown in FIG. 14, the conductor exposing part 25 is wound so as to be turned back along the upper surface 34 and the lower surface 35 of the cable winding part 26. Here, each rib 32 is arranged between the conductors 21 of the conductor exposing part 25.

Figure 15:
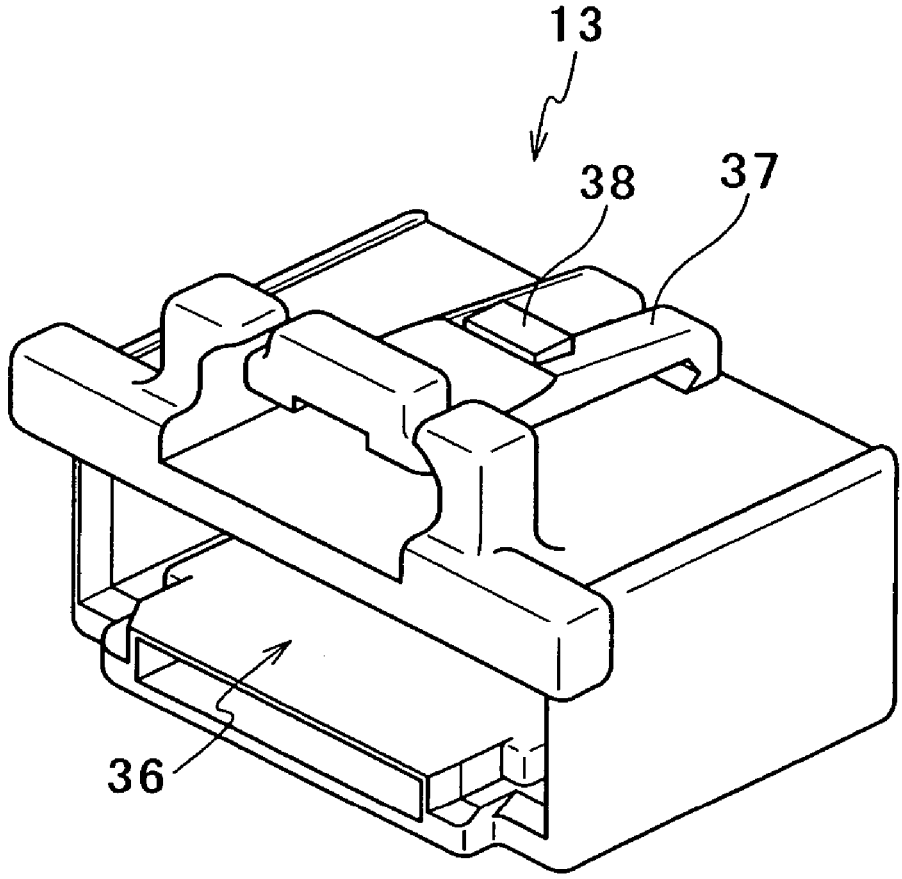
FIG. 15 is a perspective view of a fitting housing shown in FIG. 3.

FIG. 15 is a perspective view of the fitting housing 13. The external form of the fitting housing 13 is formed so as to be substantially rectangular. As shown in FIG. 10, in the fitting housing 13, the connecting end 23 of the flat cable 11 is held, and an insertion port 36 into which the cable holder 12, in which the conductor exposing part 25 is wound, is inserted is formed. The fitting housing 13 is fitted into the to-be-connected housing element 2 in a state where the cable holder 12, in which the flat cable 11 is wound and held, is inserted into the insertion port 36. Additionally, in the fitting housing 13, a flexible first elastic deforming part 37, on which a projection 38 for locking to the to-be-connected housing element 2 when the fitting housing 13 is inserted into the opening 4 of the to-be-connected housing element 2 is formed, is provided in a cantilever-shape.

Figure 16:
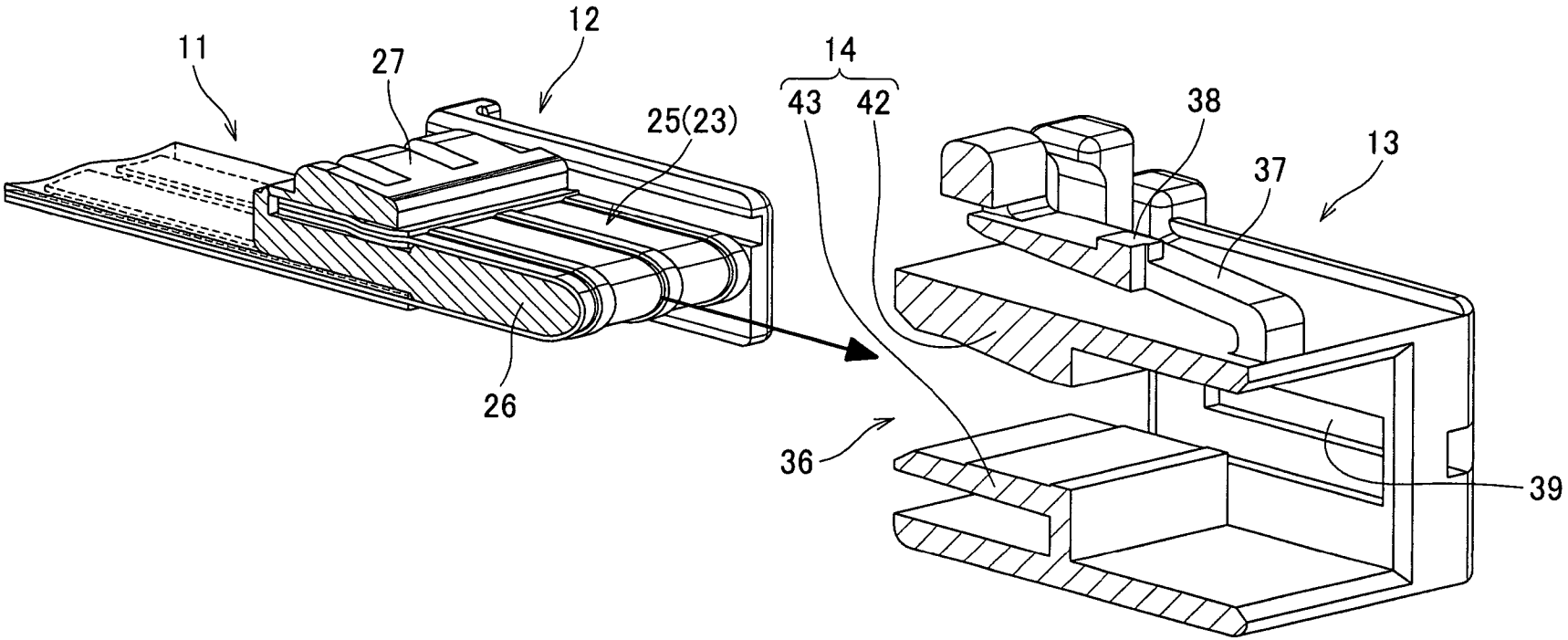
FIG. 16 is a perspective cross sectional view showing a state before the cable holder in which the flat cable is wound and held and is inserted into the fitting housing from an insertion port thereof.
Figure 17:
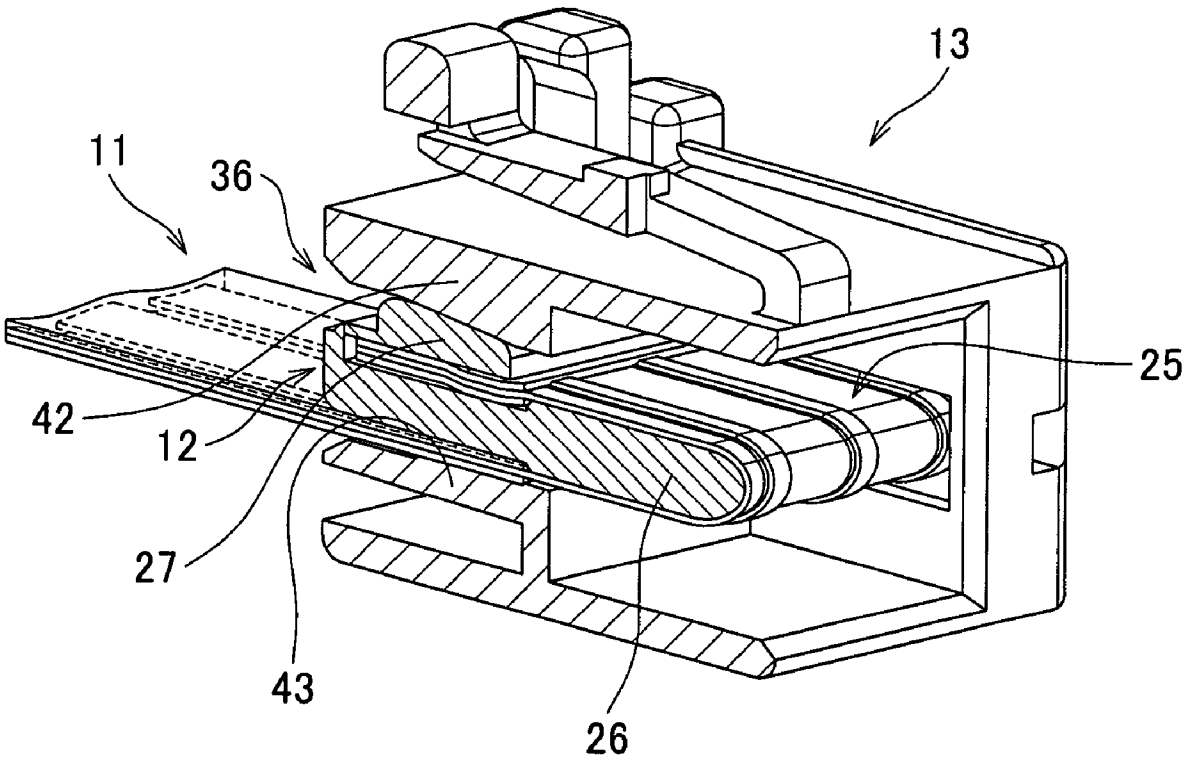
FIG. 17 is a perspective cross sectional view showing a state where the cable holder and the flat cable are inserted into the insertion port.

FIG. 16 is a perspective cross sectional view showing a state before the cable holder 12, in which the flat cable 11 is wound and held, is inserted into the insertion port 36 of the fitting housing 13. As shown in FIG. 16, the fitting housing 13 is formed in a hollow cylindrical-shape, and the cable holder 12, in which the flat cable 11 is wound, is inserted into the insertion port 36 in a direction shown by the arrow in the figure. FIG. 17 is a perspective cross sectional view showing a state where the cable holder 12 and the flat cable 11 are inserted into the insertion port 36. Moreover, second recessed parts 39 are formed on both sides in the insertion port 36 respectively (see FIG. 16), and second projecting parts 40 are formed on both sides of the cable holder 12 respectively (see FIG. 14). Thus, the second recessed part 39 is engaged with the second projecting part 40 at a place where insertion of the cable holder 12 into the insertion port 36 is completed.

Additionally, as shown in FIG. 16 and FIG. 17, the clamping part 14 is formed in the fitting housing 13 so as to be arranged in the insertion port 36. The cable holder 12, in which the flat cable 11 is wound, is inserted into the insertion port 36 so that the clamping part 14 presses the provisional holding part 27 of the cable holder 12 to the cable winding part 26, and presses and clamps the turned back connecting end 23 to the cable winding part 26 from both sides.

Additionally, as shown in FIG. 16 and FIG. 17, the clamping part 14 includes an upper side clamping part 42 and a lower side clamping part 43. The upper side clamping part 42 is formed so as to press the provisional holding part 27 of the cable holder 12 to the cable winding part 26. The upper side clamping part 42 is provided as a flexible second elastic deforming part formed so as to be extended toward the opening side of the insertion port 36 in a cantilever-shape. On the other hand, the lower side clamping part 43 is formed so as to be extended along the cable winding part 26 at the side where the flat cable 11 is wound around the cable winding part 26 of the cable holder 12 and pulled. The lower side clamping part 43 is also provided as a flexible third elastic deforming part formed so as to be extended toward the opening side of the insertion port 36 in the cantilever-shape like the upper side clamping part 42. Thus, the clamping part 14 presses and clamps the connecting end 23 turned back between the upper side clamping part 42 and the lower side clamping part 43 to the cable winding part 26 from both sides.

Figure 18:
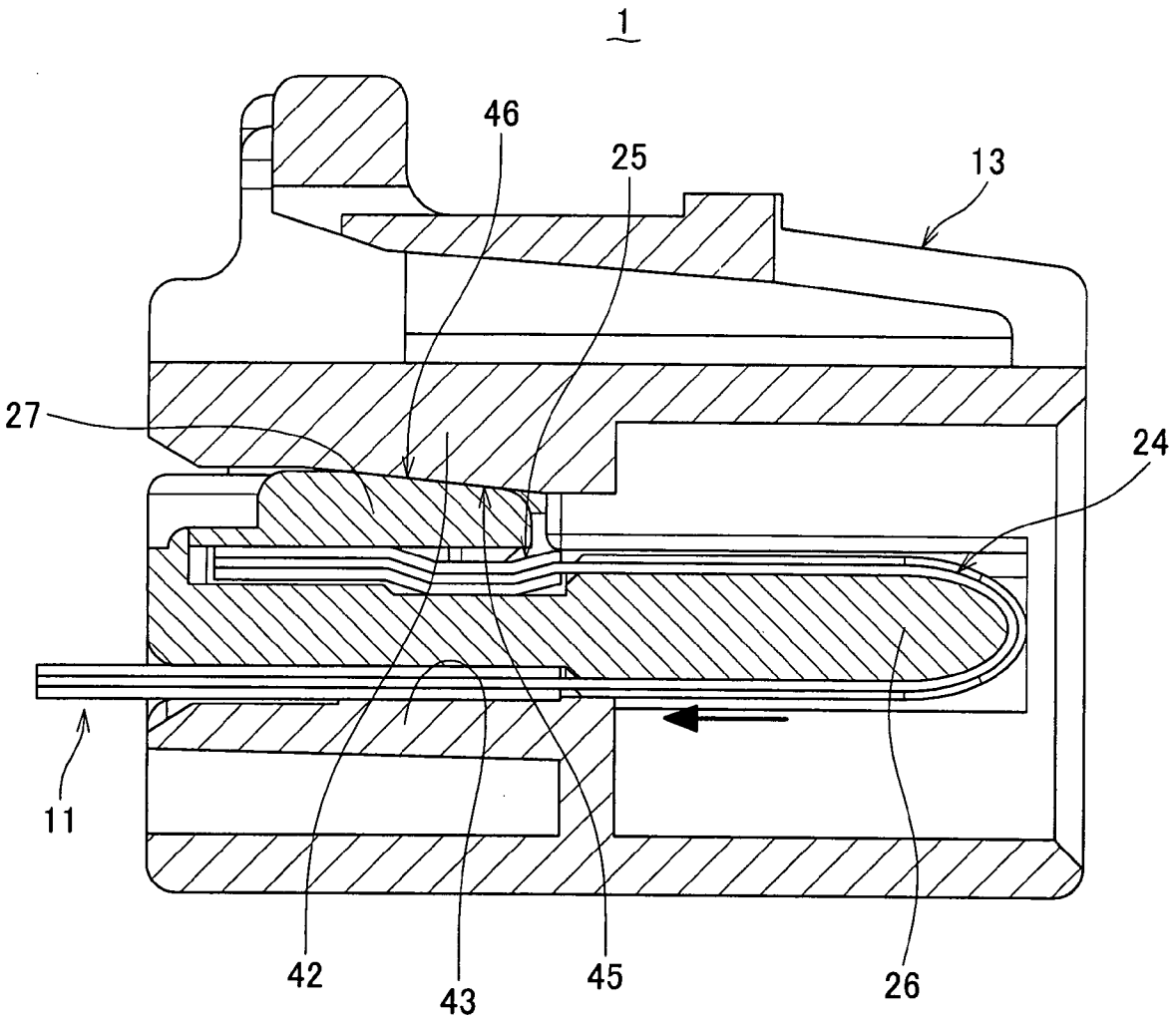
FIG. 18 is a cross sectional view of the electrical connecting device in a state where insertion of the cable holder in which the flat cable is wound into the fitting housing is completed.

FIG. 18 is a cross sectional view of the electrical connecting device 1 in a state where insertion of the cable holder 12, in which the flat cable 11 is wound, into the fitting housing 13 is completed. As shown in FIG. 18, a taper 45 formed as a taper-shaped surface is provided at the upper side clamping part 42 of the clamping part 14, and a taper 46 formed as the taper-shaped surface is provided at the provisional holding part 27 of the cable holder 12. The taper 45 of the upper side clamping part 42 side and the taper 46 at the provisional holding part 27 side are arranged so as to come into contact with and energize each other by inserting the cable holder 12, in which the flat cable 11 is wound and held, into the insertion port 36.

Moreover, the flat cable 11, of which the insulating coating part 25 of the connecting end 23 is pressed by the provisional holding part 27 and which is further wound around the cable winding part 26 and pulled, is inserted into the insertion port 36 of the fitting housing 13 together with the cable holder 12. Thus, in the inserting process, while the insulating coating part 25 of the connecting end 23 is pressed by the provisional holding part 27 brought into contact with the upper side clamping part 42, the flat cable 11 is pulled in a direction shown by the arrow in FIG. 18 by friction force generated between it and the lower side clamping part 43. And thus, the conductor exposing part 24 of the flat cable 11 can be brought into close-contact with the cable winding part 26 of the cable holder 12.

Figure 19:
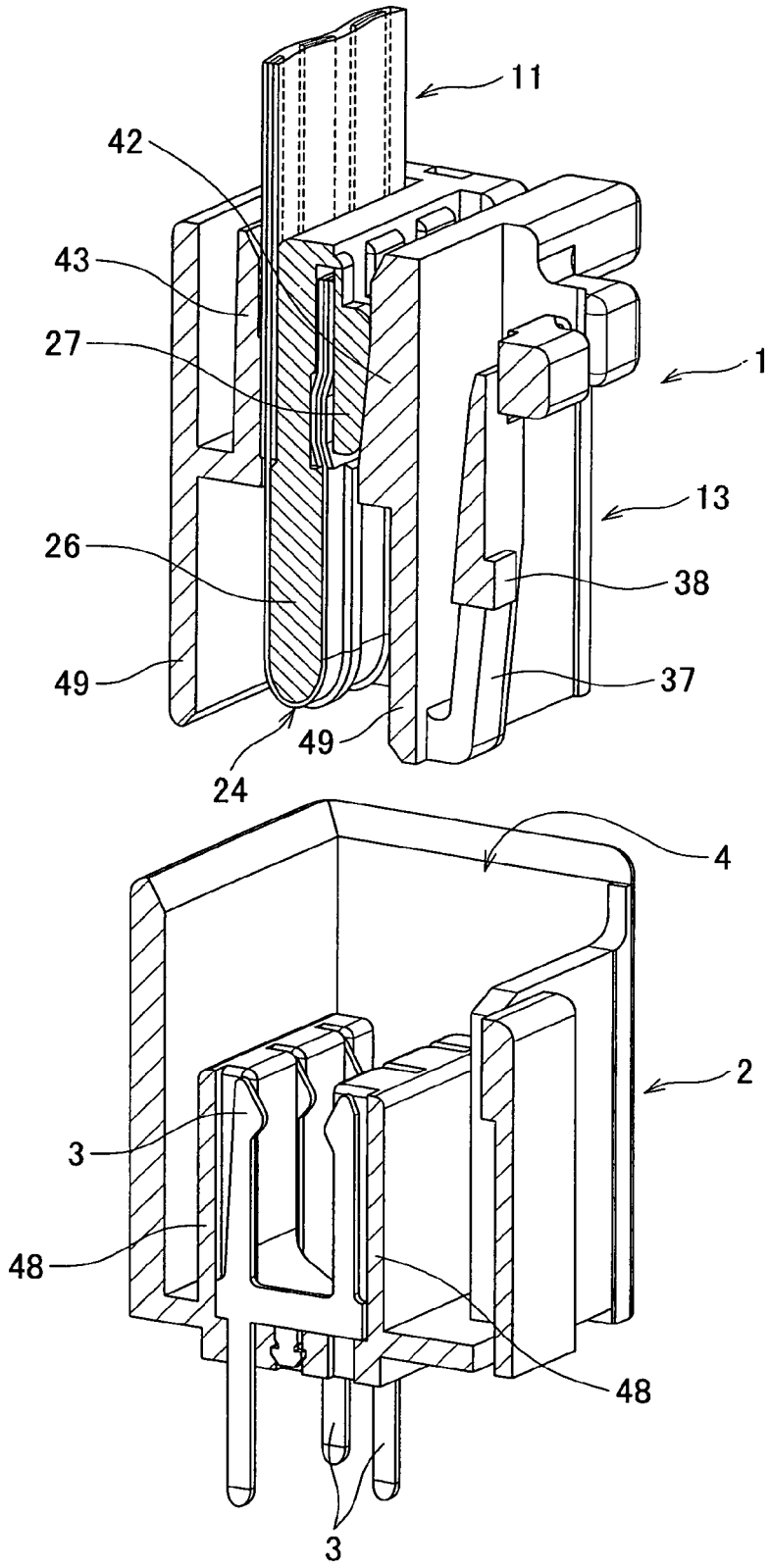
FIG. 19 is a perspective cross sectional view showing a state before the electrical connecting device in the state, where insertion of the cable holder in which the flat cable is wound into the fitting housing is completed, is connected to the to-be-connected housing element.
Figure 20:
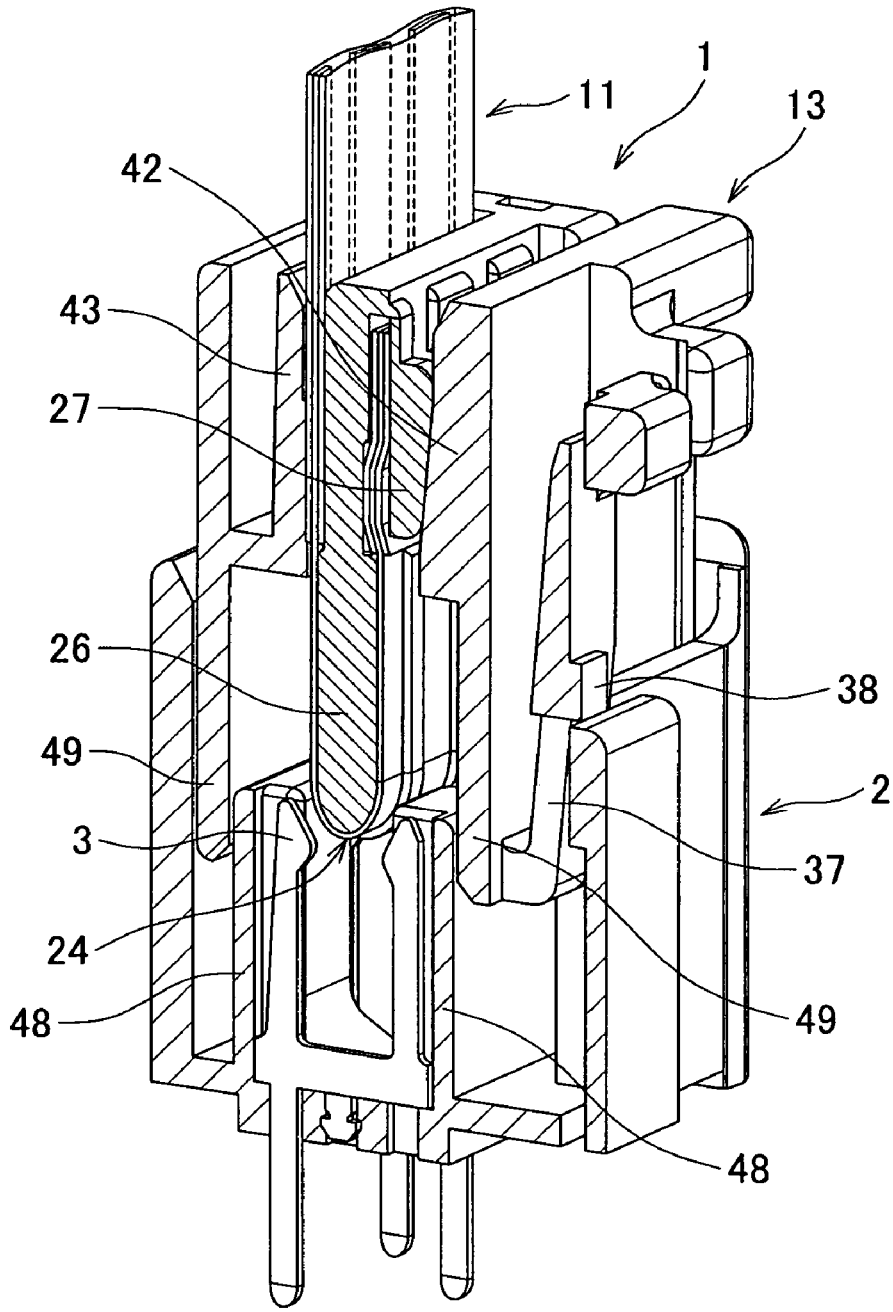
FIG. 20 is a perspective cross sectional view showing a state of the mid-process of the connection of the electrical connecting device and the to-be-connected housing element shown in FIG. 19.
Figure 21:
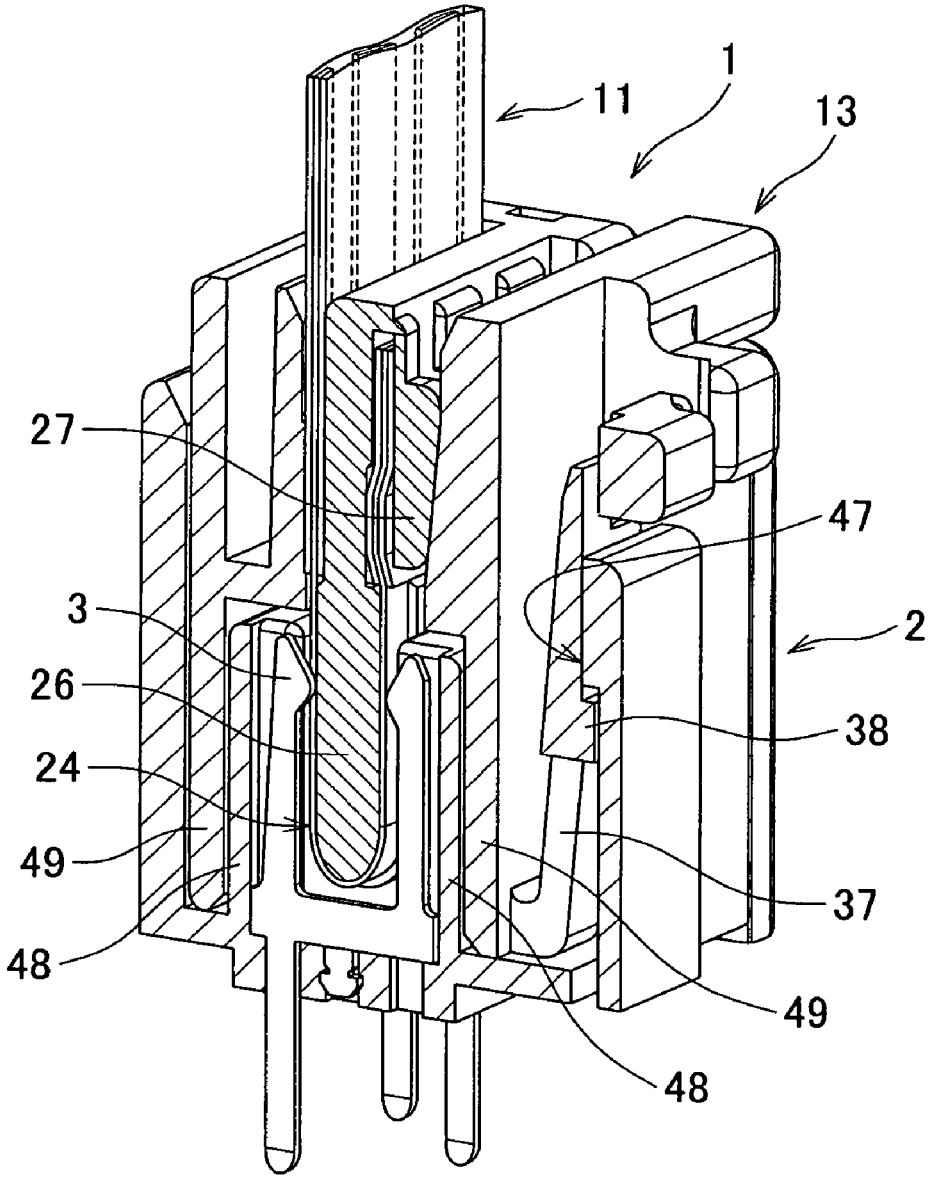
FIG. 21 is a perspective cross sectional view showing a state where the connection of the electrical connecting device and the to-be-connected housing element shown in FIG. 19 is completed.

FIG. 19 to FIG. 21 are views for description of an operation form in connecting the electrical connecting device 1 to the to-be-connected housing element 2, the electrical connecting device 1 being in the state where insertion of the cable holder 12, in which the flat cable 11 is wound, into the fitting housing 13 is completed (the state shown in FIG. 18). As shown in FIG. 19, the electrical connecting device 1 in which the flat cable 11, the cable holder 12 and the fitting housing 13 are integrally assembled is inserted into the opening 4 of the to-be-connected housing element 2 to be fitted into and connected to the to-be-connected housing element 2.

FIG. 20 is a perspective cross sectional view showing a state of the mid-process of the connection of the electrical connecting device 1 and the to-be-connected housing element 2. As shown in FIG. 20, when the electrical connecting device 1 is inserted into the opening 4 of the to-be-connected housing element 2, the projection 38 on the first elastic deforming part 37 provided in the fitting housing 13 is locked to an edge part of a circumference wall of the to-be-connected housing element 2. Moreover, in the state shown in FIG. 20, the position of the projection 38 is properly set so that a state where the conductor exposing terminal 24 of the flat cable 11 is not brought into contact with the terminals 3 is kept.

The first elastic deforming part 37 is provided so as to be extended in the cantilever-shape from a top end side to a rear end side in a fitting direction of the fitting housing 13, and the projection 38 is formed at the cantilever free end side. Thus, when the fitting housing 13 is further inserted into the opening 4 of the to-be-connected housing element 2 after the locking of the projection 38 and the to-be-connected housing element 2, the first elastic deforming part 37 is elastically deformed so that the locking of the projection 38 and the to-be-connected housing element 2 is released. When the locking of the projection 38 and the to-be-connected housing element 2 is released, the state shown in FIG. 20 is shifted to a state shown in FIG. 21 by inertial force (force that the fitting housing 13 is energized so as to be abruptly accelerated by the release of the locking and moves in the insertion direction) generated by the release of the locking, and the fitting of the fitting housing 13 and the to-be-connected housing element 2 is completed. That is, mechanical and electrical connection of the electrical connecting device 1 and the to-be-connected housing element 2 is completed. As shown in FIG. 21, in the state where the connection of the electrical connecting device 1 and the to-be-connected housing element 2 is completed, meanwhile, the conductor exposing part 24 of the flat cable 11 strongly supported by the cable holder 12 and the fitting housing 13 comes into contact with the terminals 3 supported by the to be-connected housing element 2 and an electrical connection of them is completed. Moreover, in the state where the connection of the electrical connecting device 1 and the to-be-connected housing element 2 is completed, the projection 38 on the first elastic deforming part 37 is engaged with an engaging part 47 formed in a projection-shape on an inner circumference of the to-be-connected housing element 2. Thus, a locking mechanism is generated and the electrical connecting device 1 can be locked.

Additionally, as shown in FIG. 19 to FIG. 21, a to-be-connected housing side wall 48 is formed in the to-be-connected housing element 2, and forms an inner wall erected and formed so as to surround the circumference of the plurality of terminals 3 supported by the to-be-connected housing element 2. Further, in the fitting housing 13, a fitting housing side wall 49, which is erected and formed so as to surround the circumference of the to-be-connected housing side wall 48 when the fitting housing 13 is fitted into the to-be-connected housing element 2, is formed. As clearly shown in FIG. 21, the fitting housing side wall 49 is configured so as to cover a contact region in which the conductor exposing part 24 of the flat cable 11 comes into contact with the plurality of terminals 3 when the fitting housing 13 is fitted into the to-be-connected housing element 2. Furthermore, the fitting housing side wall 49 configures a detour forming part which runs along the to-be-connected housing side wall 48 as the inner wall of the to-be-connected housing element 2 so as to form the detour which covers the above contact region and extends from the outside to the contact region.

The configuration and the operation of the electrical connecting device 1 according to the present embodiment have been described above. According to the electrical connecting device 1, the conductor exposing part 24 of the flat cable 11 is wound around the cable winding part 26 of the cable holder 12, and further the connecting end 23 is pressed and held by the provisional holding part 27. The flat cable 11 and the cable holder 12 are inserted into the insertion port 36 of the fitting housing 13 in this state, and the clamping part 14 formed in the insertion port 36 presses the provisional holding part 27 to the cable winding part 26, and presses and clamps the connecting end 23 to the cable winding part 26 from both the sides. Then, the electrical connecting device 1 is connected to the to-be-connected housing element 2, and the electrical connection of the flat cable 11 and the plurality of terminals 3 is completed.

Therefore, according to the electrical connecting device 1, the cable holder 11 is inserted into the fitting housing 13 so that the flat cable 11 wound around the cable winding part 26 and pressed by the provisional holding part 27 can be strongly held by the clamping part 14. Further, since the conductor exposing part 24 is wound around the cable winding part 26 to be turned back, the conductor exposing part 24, for which both the sides are exposed, is clamped toward the cable winding part 26 by the plurality of terminals 3, and each conductor 21 can be brought into contact with each terminal 3 by a high contact force. Therefore, the electrical connecting device 1 can reliably keep a holding state of the flat cable 11 by locking it, and can ensure a sufficient contact force between the flat cable 11 and the terminals 3, even if used under an environment that vibration or outer force is easily applied thereto.

Additionally, according to the electrical connecting device 1, since the extrusion type flat cable is employed as the flat cable 11, layer-shaped peeling can hardly arise compared with a laminate type flat cable formed by being laminated in layers.

Additionally, according to the electrical connecting device 1, the insulating coating 22 of the end side of flat cable 11 is pulled and peeled in the extending direction of the conductor 21 so that the connecting end 23 can be formed which has a configuration that the insulating coating part 25 is arranged at a top end side of the flat cable 11 and the conductor exposing part 24 is arranged adjacently to the insulating coating part 25. Thus, the insulating coating part 25 can be used as a part for being hooked on the cable holder 12 in order to improve the holding force of the flat cable 11. That is, it is unnecessary to perform a troublesome process such as opening a hole to provide a part to be hooked on the cable holder 12, therefore man-hours can be suppressed.

Additionally, according to the electrical connecting device 1, the insulating coating part 25 is bent by a simple configuration, in which the thick parts 31 are provided at the top end of the provisional holding part 27, when the provisional holding part 27 presses the connecting end 23, and therefore the holding force of the flat cable 11 can be improved.

Additionally, according to the electrical connecting device 1, since the provisional holding part 27 presses the connecting end 23 and the insulating coating part 25 is locked with the step part 28 of the cable winding part 26, the holding force of the flat cable 11 can be easily improved.

Additionally, according to the electrical connecting device 1, the conductor exposing part 24 is wound so as to be turned back along the upper surface 34 and the lower surface 35 arranged in parallel with each other in the cable winding part 26. Thus, the conductor exposing part 24, for which both the sides are exposed in parallel with each other along the upper surface 34 and the lower surface 35, can be pressed to the cable winding part 26 so as to be clamped in a direction of facing each other by the plurality of the terminals 3. And thus, each conductor 21 can be reliably brought into contact with each terminal 3 by the high contact force.

Additionally, according to the electrical connecting device 1, each rib 32 is arranged between conductors 21 extended in parallel with each other in the conductor exposing part 24 of the flat cable 11 in the state where the conductor exposing part 24 is wound around the cable winding part 26 of the cable holder 12. Thus, an insulating state between the conductors 21 is always ensured by the rib 32. Therefore, even if the interval between conductors and the interval between terminals are narrow, a short between the conductors 21 caused by a whisker generated by friction between the conductor 21 and the terminal 3 can be suppressed.

Additionally, according to the electrical connecting device 1, the connecting end 23 wound around the cable winding part 26 and pressed by the provisional holding part 27 is further strongly held by the engagement of the first projecting parts 29 and the first recessed parts 30, and the flat cable 11 can be more reliably locked.

Additionally, according to the electrical connecting device 1, when the fitting housing 13 is inserted into the to-be-connected housing element 2, the projection 38 on the first elastic deforming part 37 of the fitting housing 13 is first locked with the to-be-connected housing element 2. Then, the fitting housing 13 is further inserted into the to-be-connected housing element 2 from this state, and thus the locking of the projection 38 and the to-be-connected housing element 2 is released and the inertial force (force that the fitting housing 13 is energized so as to be abruptly accelerated by the release of the locking and moves in the insertion direction as described above) is generated. The fitting of the fitting housing 13 and the to-be-connected housing element 2 can be completed with use of the inertial force. Thus, it is possible to prevent a half-fitting state, a state of incompleted fitting, from being generated.

Additionally, according to the electrical connecting device 1, the contact region of the conductor exposing part 24 of the flat cable 11 and the terminals 3 is covered with the fitting housing side wall 49, which is the detour forming part of the fitting housing 13, in the state where the fitting housing 13 is fitted into the to-be-connected housing element 2. Further, the detour is formed between the contact region and the outside by the to-be-connected housing side wall 48, which is the inner wall in the to-be-connected housing element 2, and the fitting housing side wall 49 of the fitting housing 13. Thus, intrusion of liquid such as water from the outside to the contact region can be effectively suppressed. Additionally, since the fitting housing side wall 49 as the detour forming part is formed on the circumference of the to-be-connected housing side wall 48 which is the inner wall provided on the circumference of the plurality of terminals 3 in the to-be-connected housing element 2, the detour can be formed with a simple mechanism.

Additionally, according to the electrical connecting device 1, since the upper side clamping part 42 and the lower side clamping part 43 arranged so as to clamp the provisional holding part 27 and the cable winding part 26 from both the sides are provided, the clamping part 14 for clamping the connecting end 23 turned back, by pressing the cable winding part 26 from both the sides can be formed with the simple mechanism.

Additionally, according to the electrical connecting device 1, since the upper side clamping part 42 and the provisional holding part 27 include the tapers 45 and 46, which energize each other, respectively, the cable holder 12 is press-inserted into the insertion port 36 of the fitting housing 13 so as to be strongly clamped by the clamping part 14.

Additionally, according to the electrical connecting device 1, since the upper side clamping part 42 is formed as the flexible second elastic deforming part so as to be extended in the cantilever-shape, the provisional holding part 27 can be strongly pressed with use of elastic force of the upper side clamping part 42. Thus, a high clamping force of the clamping part 14 can be ensured by a simple configuration that the second elastic deforming part is formed.

Additionally, according to the electrical connecting device 1, since the lower side clamping part 43 is formed as the flexible third elastic deforming part so as to be extended in the cantilever-shape, the cable winding part 26 can be strongly pressed with use of elastic force of the lower side clamping part 43. Thus, the high clamping force of the clamping part 14 can be ensured by a simple configuration that the third elastic deforming part is formed.

Additionally, according to the electrical connecting device 1, the cable holder 12 is further strongly held by the fitting housing 13 owing to the engagement of the second projecting parts 40 and the second recessed parts 39, and therefore the flat cable 11 can be more reliably locked.

The embodiment of the present invention has been described as above. However, as a matter of course, the present invention is intended to embrace all modifications, variations, and their equivalents that fall within the scope of the appended claims, and such modifications and variations will be become apparent by reading and understanding this specification.

For example, the following modifications may be carried out.

(1) The present invention is applicable to a flat cable other than the extrusion type flat cable. Additionally, the present invention is applicable to a form of conductor exposing parts of the flat cables other than that described in the present embodiment.

(2) The whole shapes of the cable holder, fitting housing and clamping part, or the positions or shapes of the cable winding part, provisional holding part, insertion port, first elastic deforming part, detour forming part, upper side clamping part, lower side clamping part and the like provided therein, are not limited to those shown in the present embodiment, and modifications may be widely carried out within the scope of the appended claims.

INDUSTRIAL APPLICABILITY

An electrical connecting device of the present invention is used for electrically connecting a flat cable, which is generally called FFC (Flexible Flat Cable), FPC (Flexible Printed Cable) or the like and has a plurality of conductors, to a plurality of terminals. Additionally, the electrical connecting device of the present invention can be widely applied to an electrical connecting device that is connected to a to-be-connected housing element that supports the plurality of terminals and electrically connects the flat cable to the plurality of terminals. For example, the present invention can be employed as various connectors used for automobiles. The present invention, however, is not limited to that use, and can be applied to a wider use, in many different environments and for various purposes.

What is claimed is:

1. An electrical connecting device that is connected to a to-be-connected housing element that supports a plurality of terminals and electrically connects a flat cable to the plurality of terminals, comprising:

a flat cable having, at one end side, a connecting end provided with a conductor exposing part in which an insulating coating is removed so as to be brought into contact with and electrically connected to the plurality of terminals and a plurality of conductors are exposed;

a cable holder having a cable winding part around which the conductor exposing part is wound so as to be turned back, and a provisional holding part which is rotatably supported in relation to the cable winding part, and presses and holds the connecting end;

a fitting housing in which an insertion port, into which the cable holder is inserted with the connecting end held and the conductor exposing part wound, is formed, and which fits into the to-be-connected housing element with the cable holder inserted into the insertion port; and a clamping part which is formed in the fitting housing so as to be arranged in the insertion port, and which presses the provisional holding part to the cable winding part, and presses and clamps the connecting end turned back, to the cable winding part from both sides when the cable holder is inserted into the insertion port, wherein the connecting end of the flat cable comprises the conductor exposing part formed by pulling and peeling the insulating coating along an extending direction of the plurality of conductors, and an insulating coating part arranged so that a part of the pulled and deviated insulating coating is left in the connecting end.

2. An electrical connecting device according to claim 1, wherein thick parts are provided at a top end of the provisional holding part of the cable holder opposite the side thereof rotatably supported in relation to the cable winding part so as to bend the insulating coating part when the connecting end is pressed.

3. An electrical connecting device according to claim 1, wherein a step part capable of being locked with the insulating coating part with the connecting end pressed by the provisional holding part is provided aside of the cable winding part of the cable holder.

4. An electrical connecting device according to claim 1, wherein the cable winding part of the cable holder comprises an upper surface and a lower surface formed so as to be arranged in parallel with each other.

5. An electrical connecting device according to claim 1, wherein a plurality of ribs are formed in the cable winding part of the cable holder, so as to be respectively located between the plurality of conductors that are exposed at the conductor exposing part and arranged in parallel with each other at the time of winding the conductor exposing part.

6. An electrical connecting device according to claim 1, wherein side walls are formed which are erected at both sides of a width direction of the cable winding part of the cable holder respectively, a first projecting part is formed on either the provisional holding part or the side wall of the cable holder and a first recessed part is formed on the other, and the first projecting part is engaged with the first recessed part in a state where the provisional holding part presses the connecting end.

7. An electrical connecting device according to claim 1, wherein a flexible first elastic deforming part, on which a projection for locking to the to-be-connected housing element when the fitting housing is inserted into the to-be-connected housing element is formed, is provided in the fitting housing, and the fitting housing is inserted into the to-be-connected housing element after locking of the projection and the to-be-connected housing element so that the first elastic deforming part is deformed, hence the locking of the projection and the to-be-connected housing element is released and the fitting of the fitting housing and the to-be-connected housing element is completed.

8. An electrical connecting device according to claim 1, wherein the fitting housing comprises a detour forming part which runs along an inner wall formed in the to-be-connected housing element so as to form the detour which covers a contact region, in which the conductor exposing part comes into contact with the plurality of terminals, and leads to the contact region when the fitting housing is fitted into the to-be-connected housing element.

9. An electrical connecting device according to claim 8, wherein the inner wall in the to-be-connected housing element is a to-be-connected housing side wall erected and formed so as to surround the circumference of the plurality of terminals, and the detour forming part is a fitting housing side wall erected and formed so as to surround the circumference of the to-be-connected housing side wall when the fitting housing is fitted into the to-be-connected housing element.

10. An electrical connecting device that is connected to a to-be-connected housing element that supports a plurality of terminals and electrically connects a flat cable to the plurality of terminals, comprising:

a flat cable having, at one end side, a connecting end provided with a conductor exposing part in which an insulating coating is removed so as to be brought into contact with and electrically connected to the plurality of terminals and a plurality of conductors are exposed;

a cable holder having a cable winding part around which the conductor exposing part is wound so as to be turned back, and a provisional holding part which is rotatably supported in relation to the cable winding part, and presses and holds the connecting end;

a fitting housing in which an insertion port, into which the cable holder is inserted with the connecting end held and the conductor exposing part wound, is formed, and which fits into the to-be-connected housing element with the cable holder inserted into the insertion port; and a clamping part which is formed in the fitting housing so as to be arranged in the insertion port, and which presses the provisional holding part to the cable winding part, and presses and clamps the connecting end turned back, to the cable winding part from both sides when the cable holder is inserted into the insertion port, wherein the clamping part comprises an upper side clamping part for pressing the provisional holding part to the cable winding part and a lower side clamping part formed so as to be extended along the cable winding part at a side where the flat cable is wound around the cable winding part and pulled, and presses and clamps the connecting end turned back between the upper side clamping part and the lower side clamping part to the cable winding part from both the sides, wherein the upper side clamping part and the provisional holding part respectively comprise a taper, the tapers being formed as taper-shaped surfaces which are brought into contact with each other to be energized by inserting the cable holder into the insertion port.

11. An electrical connecting device according to claim 10, wherein the upper side clamping part is provided as a flexible second elastic deforming part formed so as to be extended in a cantilever-shape toward an opening side of the insertion port.

12. An electrical connecting device according to claim 10, wherein the lower side clamping part is provided as a flexible third elastic deforming part formed so as to be extended in the cantilever-shape toward the opening side of the insertion port.

13. An electrical connecting device according to claim 1, wherein a second projecting part is formed on either the side of the cable holder or the insertion port of the fitting housing and a second recessed part is formed on the other, and the second projecting part is engaged with the second recessed part in a position where inserting the cable holder into the insertion port is completed.

14. An electrical connecting device according to claim 2, wherein a step part capable of being locked with the insulating coating part with the connecting end pressed by the provisional holding part is provided aside of the cable winding part of the cable holder.

* * * * *